US011222588B2

(12) United States Patent
Tomitani

(10) Patent No.: US 11,222,588 B2
(45) Date of Patent: Jan. 11, 2022

(54) DISPLAY DEVICE

(71) Applicant: Japan Display Inc., Tokyo (JP)

(72) Inventor: Hisashi Tomitani, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 17/036,892

(22) Filed: Sep. 29, 2020

(65) Prior Publication Data

US 2021/0012714 A1 Jan. 14, 2021

Related U.S. Application Data

(63) Continuation of application No. 16/180,829, filed on Nov. 5, 2018, now Pat. No. 10,825,388.

(30) Foreign Application Priority Data

Nov. 27, 2017 (JP) ..... JP2017-226859

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01);
(Continued)

(58) Field of Classification Search
CPC ..... G09G 3/3233; G09G 2310/0251; G09G 2310/061; G09G 2300/0819;
(Continued)

(56) References Cited

U.S. PATENT DOCUMENTS 10,210,808 B2 * 2/2019 Jung ..... G09G 3/3233
2004/0129933 A1 * 7/2004 Nathan ..... G09G 3/3241 257/40

(Continued)

FOREIGN PATENT DOCUMENTS

JP 2006-301159 A 11/2006
JP 2006-349986 A 12/2006

(Continued)

OTHER PUBLICATIONS

Office Action issued in related Japanese Patent Application No. 2017-226859 dated Sep. 14, 2021 and English translation of same. 6 pages.

*Primary Examiner* — Jose R Soto Lopez
(74) *Attorney, Agent, or Firm* — K&L Gates LLP

(57) ABSTRACT

A display device is provided and includes display area including pixels arrayed next to one another in first direction and in second direction that is different from first direction, wherein pixels include light-emitting element configured to emit light by current flowing therethrough, drive transistor, and holding capacitance, while one terminal of light-emitting element is coupled to one of source and drain of drive transistor, first potential is supplied to other terminal of light-emitting element, second potential that is higher than first potential is supplied to other one of source and drain of drive transistor, holding capacitance is coupled between source and gate of drive transistor, and display device being configured to write initialization potentials into gates of respective drive transistors in accordance with voltage across drain and source of drive transistor, then write video writing potentials into the gates of the respective drive transistors.

10 Claims, 24 Drawing Sheets

(52) U.S. Cl.
CPC ..... *G09G 2310/0251* (2013.01); *G09G 2310/061* (2013.01); *G09G 2320/0233* (2013.01); *G09G 2320/0285* (2013.01); *G09G 2320/043* (2013.01)

(58) Field of Classification Search
CPC ... G09G 2300/0842; G09G 2320/0285; G09G 2320/043; G09G 2320/0233
See application file for complete search history.

(56) References Cited

U.S. PATENT DOCUMENTS

2005/0110723 A1* 5/2005 Shin ..... G09G 3/3233 345/76
2006/0231740 A1 10/2006 Kasai
2011/0102476 A1* 5/2011 Chang ..... G09G 3/3413 345/690
2011/0205220 A1* 8/2011 Ota ..... G09G 3/3233 345/212
2012/0001954 A1* 1/2012 Yamazaki ..... G09G 3/3659 345/690
2013/0212535 A1* 8/2013 Kim ..... G06F 3/04886 715/841
2014/0021870 A1* 1/2014 An ..... H05B 45/60 315/161
2014/0028859 A1 1/2014 Kim et al.
2014/0111404 A1* 4/2014 Omata ..... G09G 3/3233 345/76
2014/0118409 A1* 5/2014 Jun ..... G09G 3/3233 345/690
2014/0225938 A1* 8/2014 Soni ..... G09G 3/3233 345/690
2015/0077441 A1* 3/2015 Toyomura ..... G09G 3/3233 345/690
2016/0133185 A1* 5/2016 Yoon ..... G09G 3/3233 345/76
2016/0141352 A1* 5/2016 Sung ..... G11C 19/287 257/40
2016/0163265 A1* 6/2016 Yang ..... G09G 3/3233 345/690
2016/0189627 A1* 6/2016 Park ..... G09G 3/3233 345/78
2017/0004772 A1* 1/2017 Han ..... H01L 27/326
2017/0092199 A1* 3/2017 Park ..... G09G 3/3266
2017/0124953 A1* 5/2017 Shim ..... G09G 3/3233
2017/0124954 A1* 5/2017 Park ..... H01L 27/3244
2017/0186374 A1* 6/2017 Kim ..... G09G 3/3233
2017/0193922 A1* 7/2017 Pyeon ..... G09G 3/3266
2017/0294160 A1* 10/2017 Ono ..... G09G 3/3233
2018/0114492 A1* 4/2018 Kim ..... G09G 3/2088
2018/0122364 A1* 5/2018 Lim ..... G09G 3/3225
2018/0190735 A1* 7/2018 Son ..... G02F 1/133512
2018/0190824 A1* 7/2018 Bae ..... H01L 27/3262
2018/0247590 A1* 8/2018 Toyomura ..... H01L 51/5221
2018/0261154 A1* 9/2018 Toyomura ..... G09G 3/3233
2018/0308424 A1* 10/2018 Toyoda ..... G09G 3/3233
2018/0330649 A1* 11/2018 Zhu ..... G09G 3/32
2018/0350303 A1* 12/2018 Jin ..... G09G 3/2003
2018/0350995 A1* 12/2018 Kim ..... H01L 29/24
2018/0357964 A1* 12/2018 Shin ..... H01L 27/3265
2019/0035331 A1* 1/2019 Do ..... G09G 3/3413

FOREIGN PATENT DOCUMENTS

JP 2014-026256 A 2/2014
JP 2016-057359 A 4/2016

* cited by examiner

FIG.10

CORRECTION COEFFICIENT VALUE INFORMATION 8121

| Y \ X | 1 | 2 | ··· | p-1 | p |
|---|---|---|---|---|---|
| 1 | xx | xx | ··· | xx | xx |
| 2 | xx | xx | ··· | xx | xx |
| ⋮ | ⋮ | ⋮ | | ⋮ | ⋮ |
| q-1 | xx | xx | ··· | xx | xx |
| q | xx | xx | ··· | xx | xx |

FIG.17

CORRECTION COEFFICIENT VALUE INFORMATION 8121a

| Y | CORRECTION COEFFICIENT VALUE |
|---|---|
| 1 | xx |
| 2 | xx |
| ⋮ | ⋮ |
| q-1 | xx |
| q | xx |

FIG.21

CORRECTION COEFFICIENT VALUE INFORMATION

8121b

| Y \ X | 1 | 2 | ··· | m-1 | m |
|---|---|---|---|---|---|
| 1 | xx | xx | ··· | xx | xx |
| 2 | xx | xx | ··· | xx | xx |
| ⋮ | ⋮ | ⋮ | | ⋮ | ⋮ |
| n-1 | xx | xx | ··· | xx | xx |
| n | xx | xx | ··· | xx | xx |

LUMINANCE CORRECTION COEFFICIENT VALUE INFORMATION 8122

| GRADATION RANGE | LUMINANCE CORRECTION COEFFICIENT VALUE |
|---|---|
| 1 | xx |
| 2 | xx |
| ⋮ | ⋮ |
| r-1 | xx |
| r | xx |

DISPLAY DEVICE

CROSS-REFERENCE TO RELATED APPLICATIONS

This application is a continuation of U.S. application Ser. No. 16/180,829 filed on Nov. 5, 2018, which claims priority from Japanese Application No. 2017-226859, filed on Nov. 27, 2017, the contents of which are incorporated by reference herein in its entirety.

BACKGROUND

1. Technical Field

The present disclosure relates to a display device.

2. Description of the Related Art

In recent years, there has been an increasing demand for a display device that employs a liquid crystal display panel or an organic EL display panel (Organic Electro-Luminescence Display; OLED) using organic electro-luminescence emission.

An organic EL element included in the pixel of the OLED is a capacitive element. In the display device using the OLED, luminance based on the display data of the previous frame is held until the image of the next frame is displayed, and moving image blurring or the like consequently occurs and sometimes deteriorates the display quality when a moving picture is displayed. Therefore, for example, a black screen is inserted before writing the display data of next frame, so that a potential written in the previous frame is reset (For example, Japanese Patent Application Laid-open Publication No. 2016-57359 A).

In the above conventional technique, luminance non-uniformity may occur in the display screen when the potential of the power supply that feeds power to the pixels of the OLED changes.

The present disclosure is directed to providing a display device capable of preventing luminance non-uniformity.

SUMMARY

A display device according to one embodiment of the present disclosure includes a display area including a plurality of pixels arrayed next to one another in a first direction and in a second direction that is different from the first direction, and a control circuit. Each of the pixels includes a light-emitting element configured to emit light by a current flowing therethrough, a drive transistor, and a holding capacitance, while one terminal of the light-emitting element is coupled to one of a source and a drain of the drive transistor, a first potential is supplied to the other terminal of the light-emitting element, a second potential that is higher than the first potential is supplied to the other one of the source and the drain of the drive transistor, the holding capacitance is coupled between the source and a gate of the drive transistor, and the control circuit writes initialization potentials into the gates of the respective drive transistors, then writes video writing potentials resulting from a video signal into the gates of the respective drive transistors to determine voltages for the corresponding holding capacitances and cause currents to flow through the corresponding light-emitting elements throughout emission periods of the respective light-emitting elements, the voltages each being the sum of a voltage proportional to a potential difference between the corresponding video writing potential and the corresponding initialization potential and a threshold voltage of the corresponding drive transistor, the currents corresponding to voltages proportional to potential differences between the corresponding video writing potentials and the corresponding initialization potentials, and sets the initialization potentials for the respective pixels.

BRIEF DESCRIPTION OF THE DRAWINGS

FIG. 10 is a diagram illustrating an example of correction coefficient value information including a correction coefficient value for each pixel;

FIG. 17 is a diagram illustrating an example of correction coefficient value information including a correction coefficient value for each pixel row;

FIG. 21 is a diagram illustrating an example of correction coefficient value information including a correction coefficient value for each pixel group;

DETAILED DESCRIPTION

Figure 1:
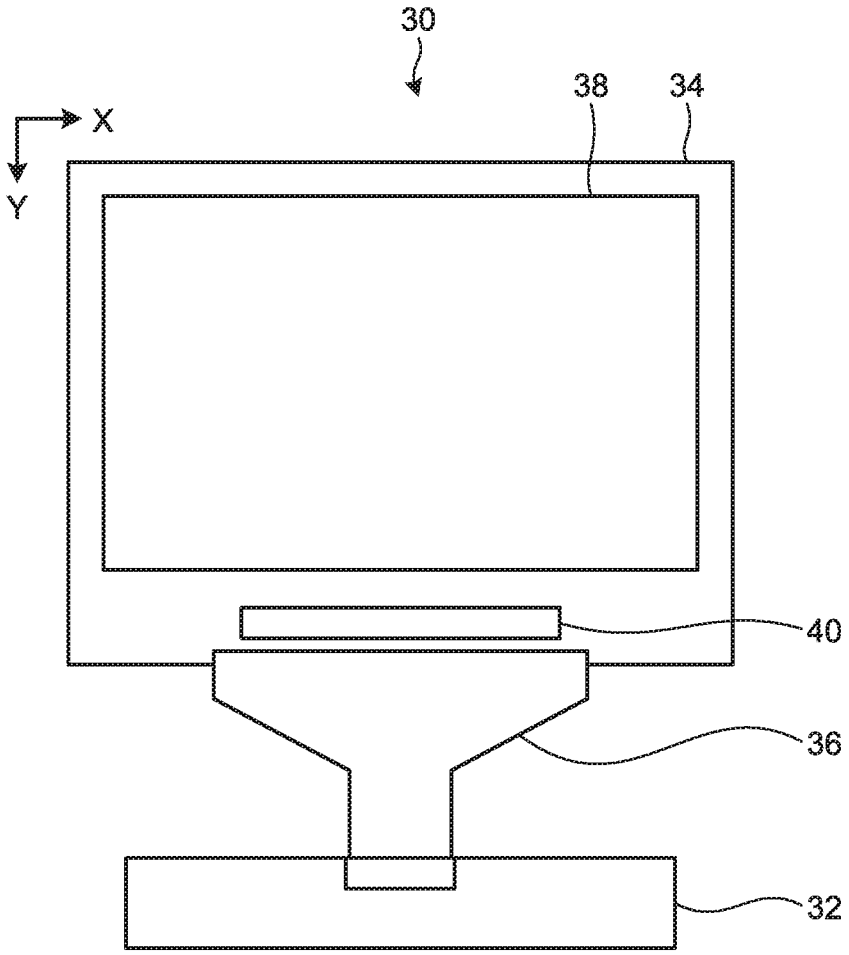
FIG. 1 is a schematic diagram illustrating a schematic configuration of a display device according to a first embodiment.

The following describes embodiments of the present disclosure with reference to the drawings. The disclosure is merely exemplary, and modifications made without departing from the spirit of the disclosure and readily apparent to the skilled person naturally fall within the scope of the present disclosure. The widths, the thicknesses, the shapes, or the like of certain devices in the drawings may be illustrated not-to-scale as compared with actual aspects, for illustrative clarity. However, the drawings are merely exemplary and not intended to limit interpretation of the present disclosure. Throughout the present description and the drawings, the same elements as those already described with reference to the drawing already referred to are assigned the same reference signs, and detailed descriptions thereof are omitted as appropriate.

First Embodiment

FIG. 1 is a schematic diagram illustrating a schematic configuration of a display device according to a first embodiment. A display device 30 includes a circuit board 32, a display substrate 34, and a connection board 36. In the present embodiment, the display device 30 is, for example, an active matrix OLED including an organic EL element (organic light-emitting diode) as a light-emitting element.

The display substrate 34 is provided with a display area 38 in which organic EL elements and pixel circuits corresponding to pixels of the display image are arranged. As a control circuit for controlling the operation of the display area 38, there are provided a drive circuit for supplying various signals to the pixel circuit, and a controller for generating a timing signal and the like to be supplied to the drive circuit. The control circuit is arranged on the circuit board 32 or the display substrate 34, for example.

For example, a drive circuit 40 for supplying signals to scan signal lines and video signal lines of the display area 38 can be arranged on the display substrate 34. The main part of the drive circuit 40 is integrated on one or a plurality of semiconductor chips, and the chip is mounted on the display substrate 34. As the drive circuit 40, alternatively, a circuit formed of a thin film transistor (TFT) or the like including a semiconductor layer made of a low temperature polysilicon or the like can be provided on the display substrate 34. The display substrate 34 can be made of, for example, a flexible material using a glass substrate, a resin film or the like.

In addition to the control circuit, components such as a power supply circuit for generating various reference potentials, a signal processing circuit for processing a video signal, and a frame memory can be arranged on the circuit board 32. The circuit board 32 is formed of, for example, a rigid substrate such as a glass epoxy substrate.

The connection board 36 couples the circuit board 32 and the display substrate 34 to each other. The connection board 36 can be formed of a flexible wiring substrate. A part or the whole of the drive circuit 40 can be arranged on the connection board 36 alternatively.

Figure 2:
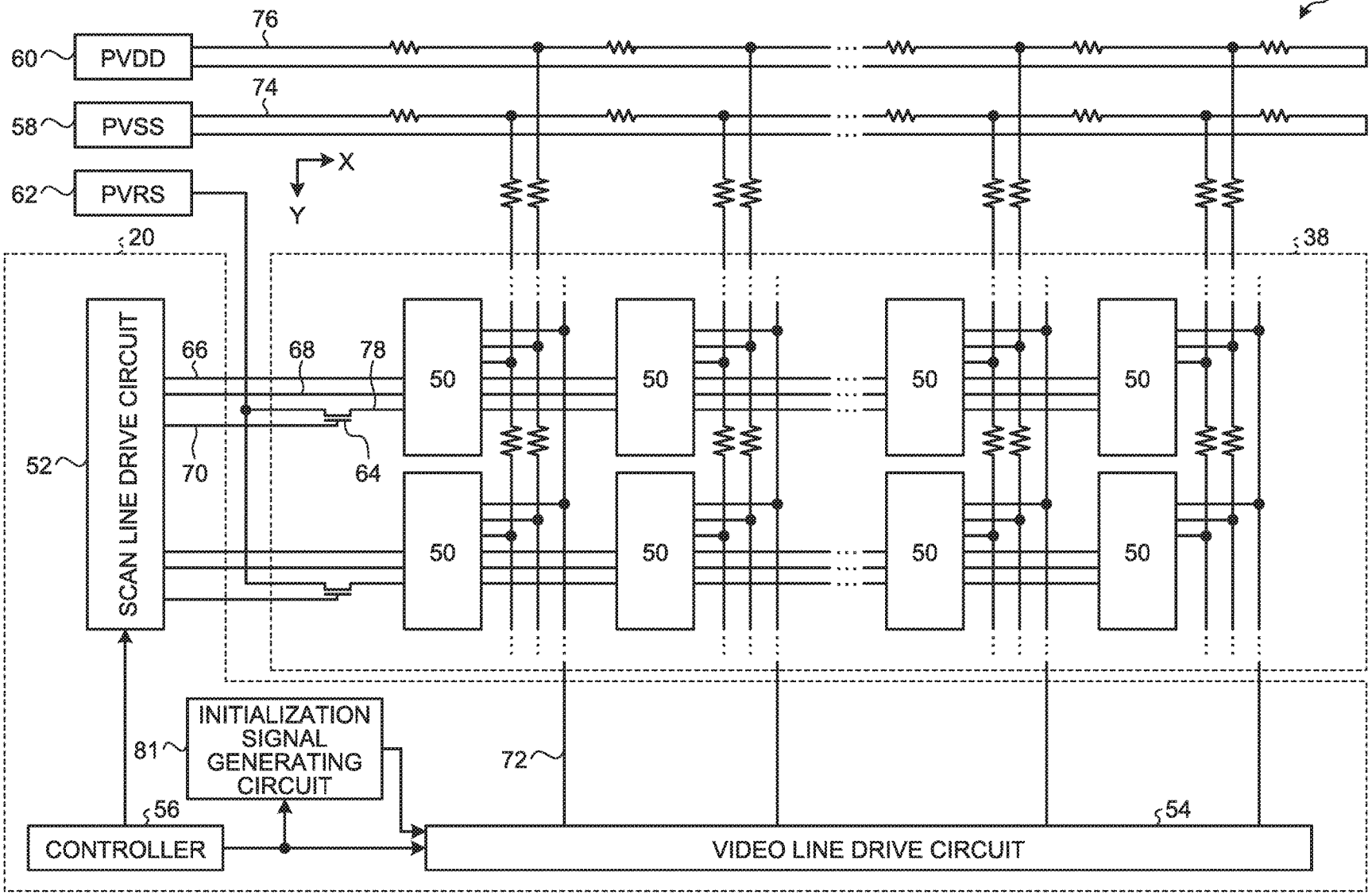
FIG. 2 is a schematic circuit diagram illustrating schematic configurations of the display area and a control circuit in the display device according to the first embodiment.

FIG. 2 is a schematic circuit diagram illustrating schematic configurations of the display area and a control circuit in the display device according to the first embodiment. In the display area 38, a plurality of pixels 50 are arrayed next to one another in the X direction (a first direction) and the Y direction (a second direction) as illustrated in FIG. 1, thus being arranged in a matrix. FIG. 2 illustrates a scan line drive circuit 52, a video line drive circuit 54, a controller 56, and an initialization signal generating circuit 81 as components of a control circuit 20 and also illustrates a power supply circuit 58, a power supply circuit 60, and a power supply circuit 62 as power supply circuits. The power supply circuit 58 is a reference power supply PVSS that outputs a reference potential $V_{SS}$, the power supply circuit 60 is a drive power supply PVDD that outputs a drive potential $V_{DD}$, and the power supply circuit 62 is a reset power supply PVRS that outputs a reset potential $V_{RS}$.

The scan line drive circuit 52 outputs a control signal for each array (hereinafter also referred to as "pixel row") of the pixels 50 in the X direction (first direction) in the display area 38. Specifically, in the present embodiment, the display area 38 includes two switches (a lighting switch 94 and a writing switch 96) in the pixel circuit of each pixel 50, and a reset switch 64 is provided for each pixel row. Correspondingly, three control signal lines (a lighting control line 66, a writing control line 68, and a reset control line 70) are provided for each pixel row, and the scan line drive circuit 52 supplies control signals for switching on/off of the above-described switches to the control lines 66, 68, and 70 of each pixel row.

The scan line drive circuit 52 includes a shift register (not illustrated) to sequentially select pixel rows to be operated by the display area 38 in the Y direction (second direction) (for example, from the upper side to the lower side of the screen in FIG. 1), generate a control signal for the selected pixel row, and output the signal to the control lines 66, 68, and 70.

The video line drive circuit 54 inputs data (pixel value) representing the video signal at each pixel 50 of the selected pixel row, converts the data into an analog voltage by a digital-to-analog (D/A) converter, and generates a voltage signal corresponding to the pixel value. The video line drive circuit 54 generates the voltage signal for each pixel row. Video signal lines (first signal lines) 72 are provided corresponding to the respective arrays (hereinafter also referred to as "pixel columns") of the pixels 50 in the Y direction (second direction) in the display area 38. The video line drive circuit 54 sequentially outputs a voltage signal (video voltage signal) VSIG representing the pixel value of each pixel 50 of each selected pixel row at the time of writing operation of data to each pixel 50 from one selected pixel row to another.

The initialization signal generating circuit 81 generates data values of initialization voltage signals VINI to be supplied to the video signal lines (first signal lines) 72 of the respective pixel columns at the time of data initialization for each pixel 50, and outputs the data values to the video line drive circuit 54. Details of the configuration and operation of the initialization signal generating circuit 81 will be described later.

The power supply circuit 58 generates the reference potential $V_{SS}$ as described above. The reference potential $V_{SS}$ is supplied to each pixel 50 via a power supply line 74.

The power supply circuit 60 generates the drive potential $V_{DD}$ as described above. The drive potential $V_{DD}$ is supplied to each pixel 50 via a power supply line 76 as described above.

The power supply circuit 62 generates the reset potential $V_{RS}$. The reset potential $V_{RS}$ is supplied to each pixel 50 via the reset switch 64 and a reset line 78 that are provided for the corresponding pixel row.

Figure 3:
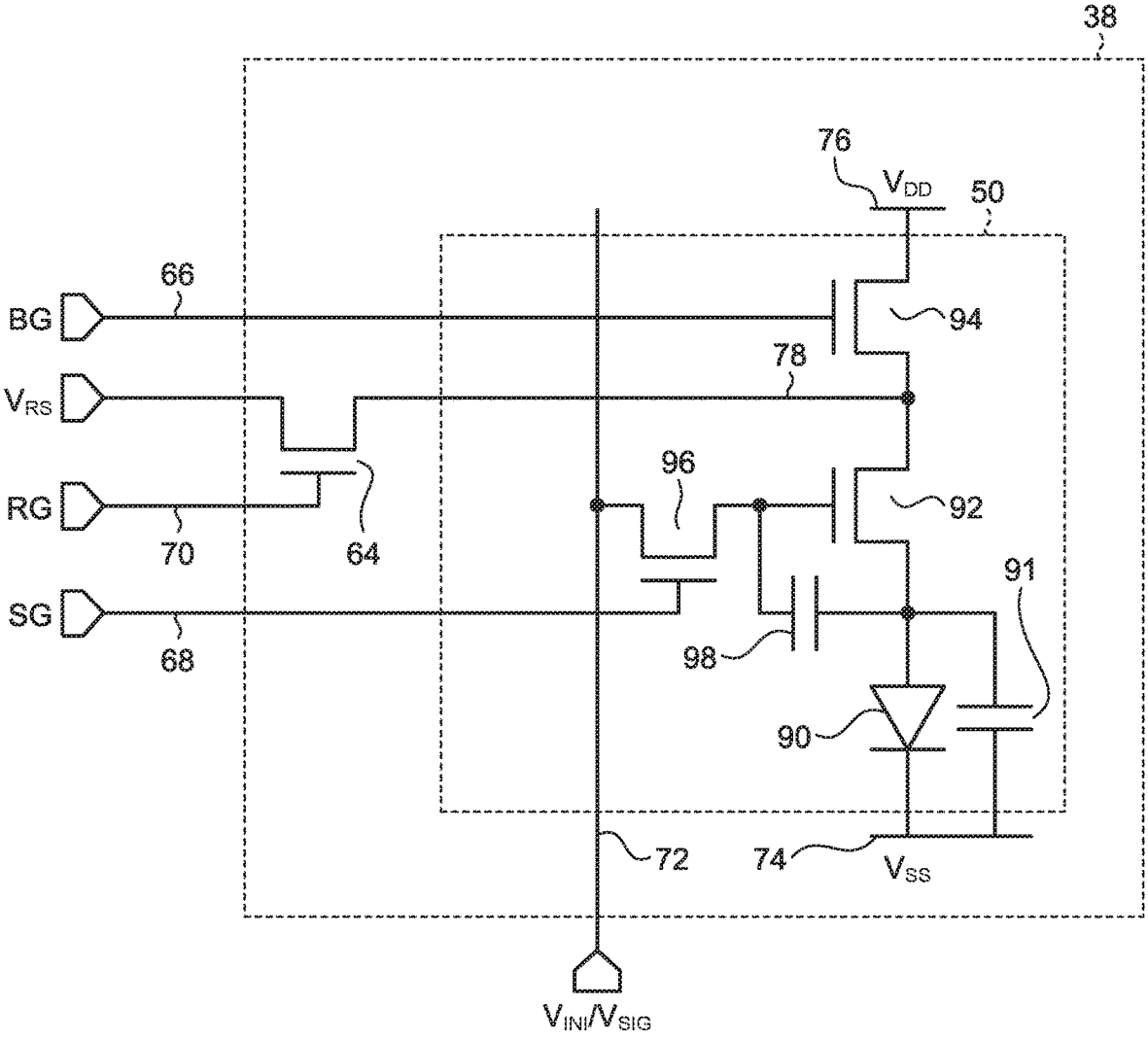
FIG. 3 is an example of a schematic equivalent circuit diagram of a pixel arranged in the display area illustrated in FIG. 2.

FIG. 3 is an example of a schematic equivalent circuit diagram of a pixel arranged in the display area illustrated in FIG. 2.

Each pixel 50 includes an organic light-emitting diode (organic EL element) 90 as a light-emitting element. In the present embodiment, the organic light-emitting diode 90 includes an anode electrode, a cathode electrode, and an organic material layer such as a light emitting layer between the electrodes. The cathode electrode can be a common electrode integrally formed over a plurality of pixels of the display area 38. The emission color of the organic light-emitting diode 90 may be, for example, red, green, blue or the like. The display device 30 may be configured to be capable of color display with the pixels 50, which include respective organic light-emitting diodes 90 having emission colors of red, green, blue, and the like, arrayed regularly in the X direction (first direction) or in the Y direction (second direction) in the display area 38.

The cathode electrode of the organic light-emitting diode 90 is coupled to the power supply line 74. The anode electrode of the organic light-emitting diode 90 is coupled to the power supply line 76 via a drive transistor 92 and a lighting switch 94.

As described above, a certain high potential as the drive potential $V_{DD}$ is applied to the power supply line 76 from the drive power supply PVDD (power supply circuit 60), and a certain low potential is applied as the reference potential $V_{SS}$ to the power supply line 74 from the reference power supply PVSS (power supply circuit 58).

The organic light-emitting diode 90 emits light when a forward-direction current is supplied because of the potential difference ($V_{DD}-V_{SS}$) between the drive potential $V_{DD}$ and the reference potential $V_{SS}$. That is, the drive potential $V_{DD}$ has a potential difference that causes the organic light-emitting diode 90 to emit light with respect to the reference potential $V_{SS}$. The organic light-emitting diode 90 is configured as an equivalent circuit with a capacitance 91 coupled in parallel thereto between an anode electrode and a cathode electrode. The capacitance 91 may be coupled between an anode electrode and another reference voltage other than the reference potential $V_{SS}$.

In the present embodiment, the drive transistor 92 and the lighting switch 94 are each composed of an n-type TFT. A source electrode that is one (first terminal) of the two current terminals of the drive transistor 92 is coupled to the anode electrode of the organic light-emitting diode 90, and a drain electrode that is the other (second terminal) thereof is coupled to the source electrode of the lighting switch 94. The drain electrode of the lighting switch 94 is coupled to the power supply line 76.

The drain electrode of the drive transistor 92 is also coupled to the reset power supply PVRS (power supply circuit 62) via the reset switch 64. As already described, in the present embodiment, the reset line 78 and the reset switch 64 are provided for each pixel row. The reset lines 78 extend along the respective pixel rows and are each coupled to all of the drain electrodes of the drive transistors 92 of the corresponding pixel row. The reset switch 64 is placed, for example, at the end of the pixel row and switches between coupling and decoupling of the reset line 78 to and from the reset power supply PVRS (power supply circuit 62), that is, whether to couple or decouple them. In the present embodiment, the reset switch 64 is composed of an n-type TFT like the drive transistor 92 and the lighting switch 94.

The gate electrode, which is the control terminal of the drive transistor 92, is coupled to the video signal line (first signal line) 72 via the writing switch 96, and a holding capacitance 98 is coupled between the gate electrode and the source electrode of the drive transistor 92. In the present embodiment, the writing switch 96 is composed of an n-type TFT like the drive transistor 92, the lighting switch 94, and the reset switch 64.

In the present embodiment, a circuit example in which the drive transistor 92, the lighting switch 94, the reset switch 64, and the writing switch 96 are formed of n-type TFTs is presented, but is not limiting. For example, the drive transistor 92, the lighting switch 94, the reset switch 64, and the writing switch 96 may be circuits formed of p-type TFTs. The circuit configuration in which a p-type TFT and an n-type TFT are combined may be used. Hereinbelow, a case in which the drive transistor 92, the lighting switch 94, the reset switch 64, and the writing switch 96 are n-type TFTs will be taken as an example.

As described above, the lighting switch 94, the writing switch 96, and the reset switch 64 are controlled on/off by use of the lighting control line 66, the writing control line 68, and the reset control line 70 provided to each pixel row. The lighting control line 66 and the writing control line 68 extend along the pixel row and are coupled to the gate electrodes of the lighting switch 94 and the writing switch 96 of the pixel row in common.

Figure 4:
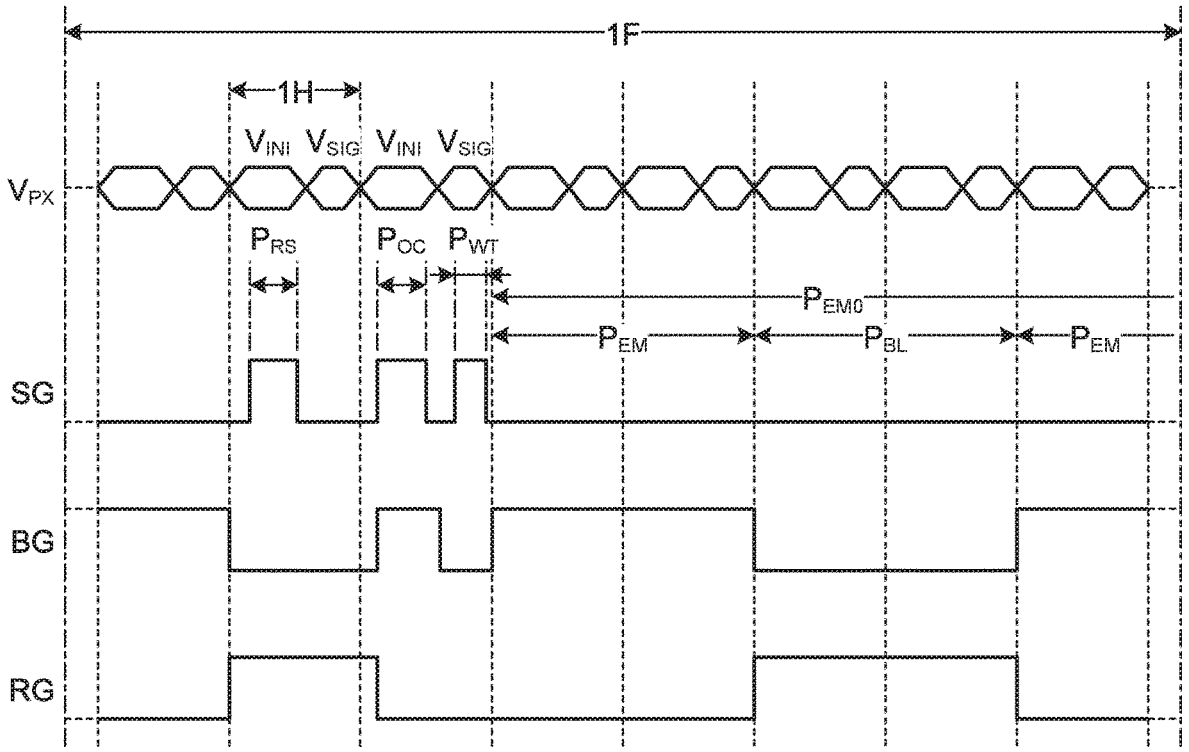
FIG. 4 is a schematic timing chart for explaining a driving method for the display device according to the first embodiment.

FIG. 4 is an exemplary timing chart for explaining a driving method for the display device according to the first embodiment. FIG. 4 illustrates: the writing operation of the pixel value in one pixel row of the display area 38; and changes of various signals in the emission operation.

In FIG. 4, the horizontal axis represents the time axis, and the rightward direction is the passage of time. The various signals illustrated in FIG. 4 are: the video voltage signal VPX supplied from the video line drive circuit 54 to the video signal line (first signal line) 72; the writing control signal SG for the writing switch 96; the lighting control signal BG for the lighting switch 94; and the reset control signal RG for the reset switch 64. The scan line drive circuit 52 sets each control signal to either the L level or the H level. In the present embodiment, the writing switch 96, the lighting switch 94, and the reset switch 64, which are formed of n-type TFTs, are turned on at the H level and turned off at the L level.

In the present embodiment, a plurality of pixel rows included in the display area 38 are sequentially selected from the first row (for example, the pixel row located at the uppermost position in the display area 38 in FIG. 1), and the operation of writing the potentials Vsig (video writing potentials) of the video voltage signals VSIG to pixels in the selected pixel row to cause the organic light-emitting diodes 90 to emit light is repeated for each image of one frame (1F).

The writing operation in the present embodiment is specifically divided into a reset operation, an offset cancelling operation, and a video signal setting operation. In the example illustrated in FIG. 4, the reset period PRS corresponds to the reset operation, the offset cancelling period $P_{OC}$ corresponds to the offset cancelling operation, and the video signal setting period $P_{WT}$ corresponds to the video signal setting operation.

The reset operation is an operation of resetting voltages held in the capacitance 91 and the holding capacitance 98. As a result, the data written into the pixels 50 in the previous frame according to the video signal is reset.

Specifically, in the reset operation, the lighting switch 94 is turned off by setting the lighting control signal BG to the L level, the reset switch 64 is turned on by setting the reset control signal RG to the H level, and further, the writing switch 96 is turned on by setting the writing control signal SG to the H level with the potentials Vini (initialization potentials) of the initialization voltage signals VINI applied to the respective video signal lines (first signal lines) 72.

As a result, the potential corresponding to the potential Vini (initialization potential) of the initialization voltage signal VINI is applied to the gate potential of the drive transistor 92, and a voltage corresponding to the reset potential $V_{RS}$ is applied to the anode electrode side of the organic light-emitting diode 90. As a result, the source potential of the drive transistor 92 is reset to a potential corresponding to the reset potential $V_{RS}$, and the terminal-to-terminal voltage of the holding capacitance 98 of each pixel 50 is set to a voltage corresponding to (Vini−$V_{RS}$). The voltage applied to the organic light-emitting diode 90 reaches a voltage corresponding to ($V_{RS}$−$V_{SS}$), and the reset potential $V_{RS}$ is set so that this voltage can be lower than or equal to an emission threshold voltage (light emission starting voltage) of the organic light-emitting diode 90. The emission threshold voltage is a voltage at which a current begins to flow through the organic light-emitting diode 90, that is, a forward voltage drop VF. The potential Vini (initialization potential) of the initialization voltage signal VINI can be set to 1 V, for example. For example, when the reference potential $V_{SS}$ is set to −1 V, the reset potential $V_{RS}$ can be set to −3 V. That is, the reset potential $V_{RS}$ is set to a potential such that no current flows through the organic light-emitting diode 90 during the reset operation.

The offset cancelling operation is operation for compensating variations in threshold voltage Vth of the drive transistors 92.

Specifically, in the offset cancelling operation, the reset switch 64 is turned off by setting the reset control signal RG to the L level, the writing switch 96 and the lighting switch 94 are turned on by setting the writing control signal SG and the lighting control signal BG to the H level, and the potential Vini (initialization potential) of the initialization voltage signal VINI is applied to each of the video signal lines (first signal lines) 72.

As a result, the gate potential of the drive transistor 92 is fixed at a potential corresponding to the potential Vini (initialization potential) of the initialization voltage signal VINI. Because the lighting switch 94 is on, a current flows into the drive transistor 92 from the drive power supply PVDD, so that the source potential of the drive transistor 92 rises from the reset potential $V_{RS}$ that has been written during the reset period PRS. When the source potential reaches a potential (Vini−Vth) that is Vth lower than the gate potential, the drive transistor 92 becomes non-conductive, so that while the source potential of the drive transistor 92 is fixed at the potential (Vini−Vth), the terminal-to-terminal voltage of the holding capacitance 98 is set to a voltage corresponding to the threshold voltage Vth of the drive transistor 92. On the basis of this state, the video signal setting operation is performed to set the lighting control signal BG to the L level to turn the lighting switch 94 off and to write a voltage corresponding to the potential Vsig (video writing potential) of the video voltage signal VSIG into the holding capacitance 98. Consequently, effects attributable to variations in threshold voltage Vth of the drive transistors 92 among the pixels 50 due to currents flowing through the drive transistors 92 as a result of the emission operation are cancelled.

The video signal setting operation is operation for writing the potential Vsig (video writing potential) of the video voltage signal VSIG to each of the pixels 50.

In the video signal setting period $P_{WT}$, the reset control signal RG is maintained at the L level continuously from the offset cancelling period $P_{OC}$. The lighting control signal BG is set to the L level, so that the lighting switch 94 is turned off and that a current is stopped from flowing into the drive transistor 92 from the drive power supply PVDD (power supply circuit 60). In this state, when the writing switch 96 is turned on by setting the writing control signal SG to the H level while the potential Vsig (video writing potential) of the video voltage signal VSIG is supplied to each of the video signal lines (first signal lines) 72, the capacitance 91 and the holding capacitance 98 are charged and the gate potential of the drive transistor 92 rises to a potential corresponding to the potential Vsig (video writing potential) of the video voltage signal VSIG from a potential corresponding to the potential Vini (initialization potential) of the initialization voltage signal VINI.

When the video signal setting operation is ended by turning off of the writing switch 96, an emission-enabled period $P_{EM0}$ is entered in which the organic light-emitting diode 90 can emit light. In this emission-enabled period $P_{EM0}$, when the lighting switch 94 is turned on by setting the lighting control signal BG to the H level, the organic light-emitting diode 90 emits light with an intensity corresponding to the potential Vsig (video writing potential) of the video voltage signal VSIG (emission period $P_{EM}$). That is, even after the writing switch 96 is turned off, the drive transistor 92 that has become conductive in the video signal setting operation is maintained conductive by the voltage held by the holding capacitance 98, and a drive current corresponding to the potential Vsig (video writing potential) of the video voltage signal VSIG is supplied to the organic light-emitting diode 90. As a result, the organic light-emitting diode 90 emits light with luminance corresponding to the potential Vsig (video writing potential) of the video voltage signal VSIG.

The above-described writing operation (the reset operation, the offset cancelling operation, and the video signal setting operation) and emission operation are sequentially performed with respect to each pixel row included in the display area 38. The pixel rows are sequentially selected, for example, in cycles of one horizontal scan period (1H) of a video signal, and the writing operation and the emission operation for each pixel row are repeated in cycles of one frame period (1F).

In the example illustrated in FIG. 4, each horizontal scan period (1H) includes a period ($V_{INI}$ period) for which the potential Vini (initialization potential) of the initialization voltage signal VINI is applied to the video signal line (first signal line) 72 and a period ($V_{SIG}$ period) for which the potential Vsig (video writing potential) of the video voltage signal VSIG is applied thereto.

The video line drive circuit 54 outputs a video voltage signal VSIG in the video signal setting period $P_{WT}$ set within the $V_{SIG}$ period. In this case, the offset cancelling period $P_{OC}$ is set within the VINI period within the same horizontal scan period as the one within which the period $V_{SIG}$ is set during which the video voltage signal VSIG is output. The reset period $P_{RS}$ is set within the VINI period during the horizontal scan period that is 1H before the horizontal scan period within which the $V_{SIG}$ period is set during which the video voltage signal VSIG is output.

The emission period $P_{EM}$ of the organic light-emitting diode 90 in each pixel row is set within a period (emission-enabled period $P_{EM0}$) that spans from the end of the above-described video signal setting operation until the start of the writing operation with respect to that pixel row for an image of the next frame. In the display device 30 in the present embodiment, as a part of the emission-enabled period $P_{EM0}$, a non-emission period $P_{BL}$ is set for black-screen insertion operation, throughout which the lighting switch 94 is controlled to decouple the drive power supply PVDD from the drive transistor 92 that has been held conductive and to thereby force the drive current to stop being supplied to the organic light-emitting diode 90. As a result, the above-described display quality deterioration due to moving image blurring is prevented.

That is, the emission period $P_{EM}$ is a period within the emission-enabled period $P_{EM0}$ other than the non-emission period $P_{BL}$. Black-screen insertion works to cancel an after-image generated from an image of a certain frame and left on the retina, and this cancellation brings the effect of preventing moving-image display quality from deteriorating. It is therefore preferable that the non-emission period $P_{BL}$ be set at or near the very beginning of the emission-enabled period $P_{EM0}$ or at or near the very end thereof. For example, FIG. 4 illustrates an example that has the third and fourth horizontal scan periods almost in the very beginning of the emission-enabled period $P_{EM0}$, which constitutes a large part of the one-frame period (1F) typically composed of at least 100 horizontal scan periods, set as the non-emission period $P_{BL}$. The length of the non-emission period $P_{BL}$ is basically allowed to be extremely larger than the emission-enabled period $P_{EM0}$, black-screen insertion scarcely affect the brightness of an image.

As described above, the lighting switch 94 decouples the drive power supply PVDD and the organic light-emitting diode 90 from each other throughout the non-emission period $P_{BL}$. Specifically, the scan line drive circuit 52 sets the lighting control signal BG to the L level to turn the lighting switch 94 off. In this non-emission period $P_{BL}$, the scan line drive circuit 52 further controls the reset switch 64 to set the reset line 78 to the reset potential $V_{RS}$ throughout the non-emission period $P_{BL}$. That is, setting the reset control signal RG to the H level throughout the non-emission period $P_{BL}$ for which the lighting switch 94 is off causes the reset switch 64 to be on and thereby causes the reset power supply PVRS (power supply circuit 62) to be coupled to the reset line 78. That is, in the present embodiment, the reset switch 64 and the lighting switch 94 are exclusively turned on.

Thus, even when there is a high-resistance short circuit between the reset line 78 and any other wiring, the drain of the drive transistor 92 is maintained at a potential corresponding to the reset potential $V_{RS}$. In other words, a current generated by such a short circuit flows from the reset line 78 toward the reset power supply PVRS (power supply circuit 62) via the reset switch 64 but does not flow into the organic light-emitting diode 90. The occurrence of phenomena, such as disappearance of a horizontal line or emergence of a horizontal seam on the screen of the display area 38, due to light emission using that current by the pixels 50 that are coupled in common to the reset line 78 are consequently prevented.

Figure 5:
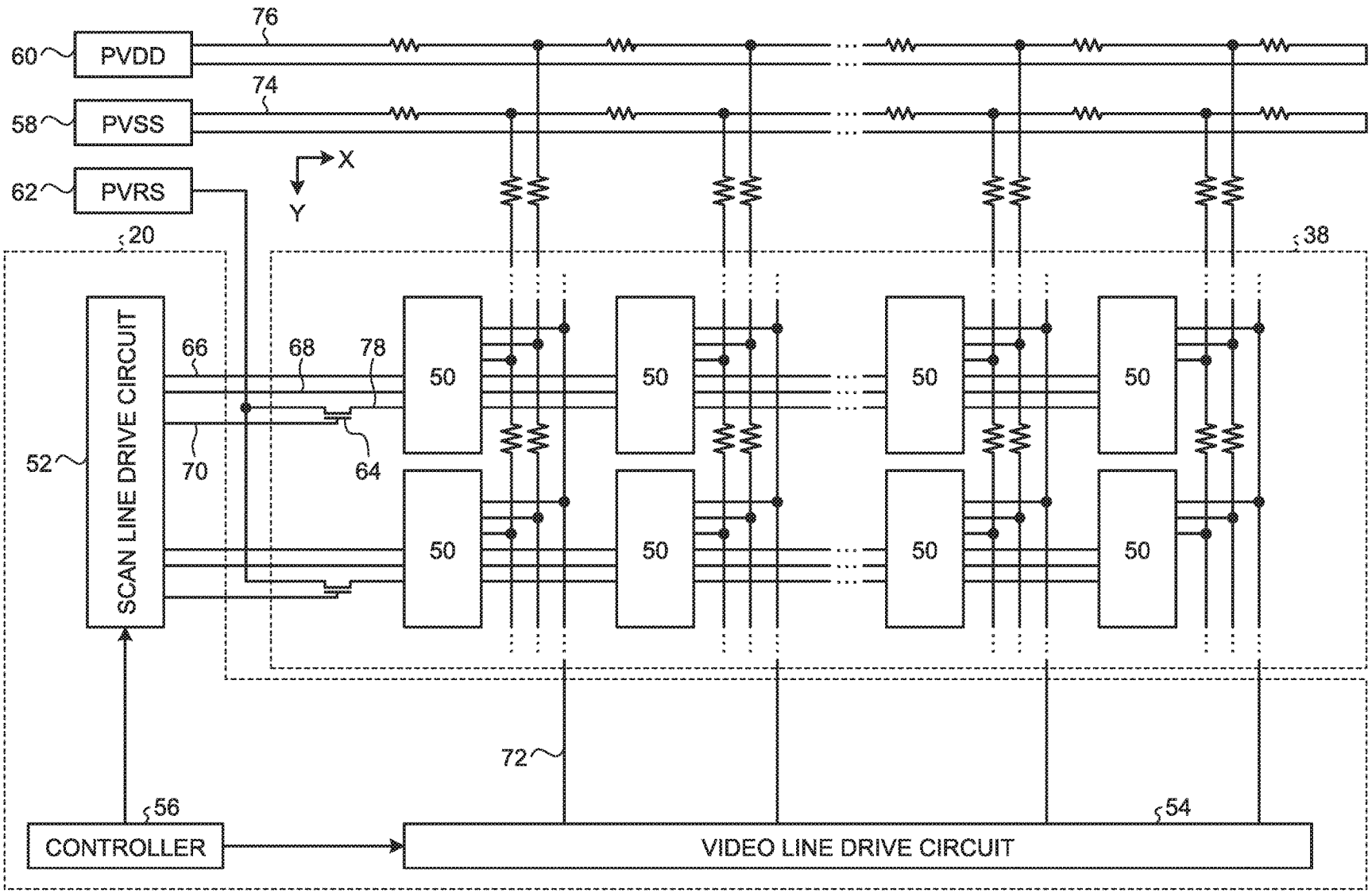
FIG. 5 is a schematic diagram illustrating a schematic configuration of a display device according to a comparative example of the first embodiment.
Figure 6:
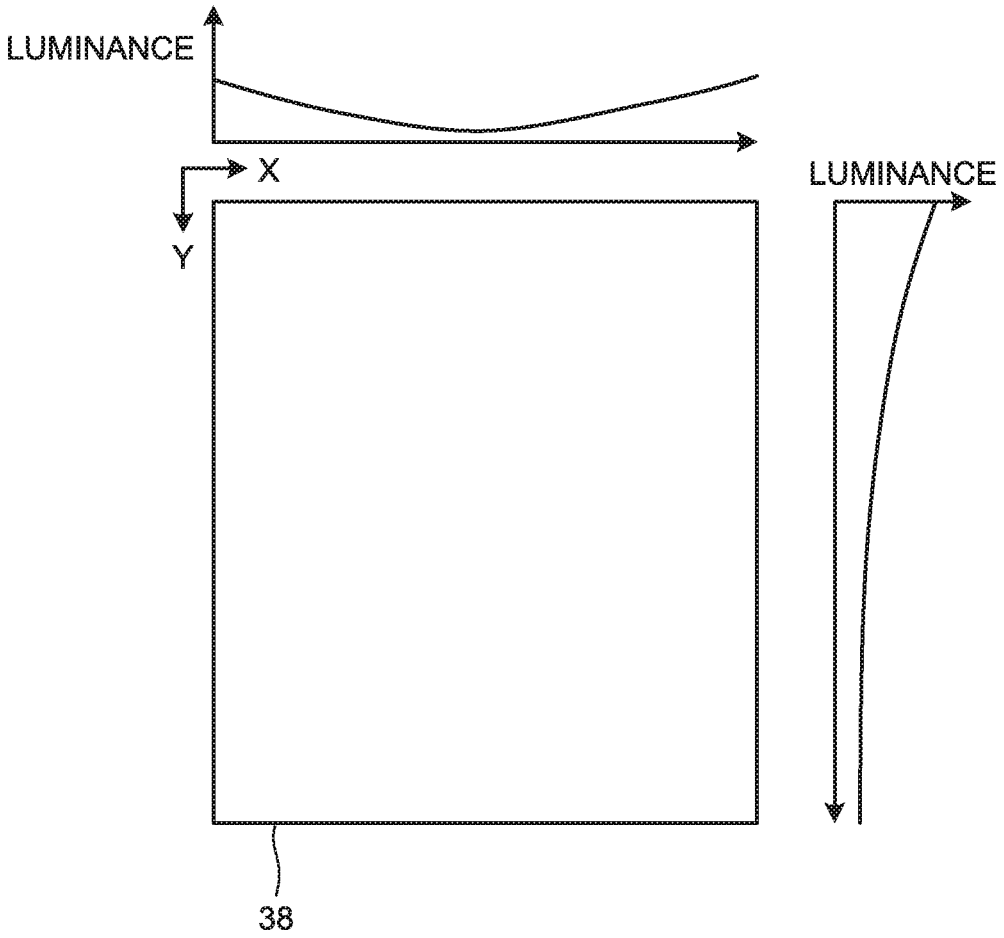
FIG. 6 is a diagram illustrating an example in which luminance non-uniformity occurs on the screen of the display area when a monochrome raster is displayed in the comparative example illustrated in FIG. 5.

FIG. 5 is a schematic diagram illustrating a schematic configuration of a display device according to a comparative example of the first embodiment. FIG. 6 is a diagram illustrating an example in which luminance non-uniformity occurs on the screen of the display area when a monochrome raster is displayed in the comparative example illustrated in FIG. 5. FIG. 6 illustrates an example in which the drive potential $V_{DD}$ and the reference potential $V_{SS}$ are supplied to each of the pixels 50 in the display area 38 from both of the opposite sides in the upper part of FIG. 6.

In the comparative example illustrated in FIG. 5, an initialization signal generating circuit 81 is not included unlike in the display device 30 illustrated in FIG. 2 according to the first embodiment. That is, the comparative example illustrated in FIG. 5 has a configuration such that, when data for each pixel 50 is initialized, the initialization voltage signal VINI is generated by the video line drive circuit 54 and output to the video signal lines (first signal lines) 72 of the respective pixel columns.

The terminal-to-terminal voltage of the holding capacitance 98 in each pixel 50 in the pixel configuration illustrated in FIG. 3, that is, the gate-source voltage Vgs of the drive transistor 92 can be expressed by Mathematical Expression (1) with the capacitance value of the holding capacitance 98 denoted as Cs and with the capacitance value of the capacitance 91 denoted as Cel.

$$Vgs=Vsig-(Vini-Vth+(Vsig-Vini)*Cs/(Cs+Cel))=(Vsig-Vini)*(1-Cs/(Cs+Cel))+Vth \quad (1)$$

As expressed by Mathematical Expression (1) above, the gate-source voltage Vgs of the drive transistor 92 takes a value that is a sum of: a voltage proportional to the potential difference (Vsig−Vini) between the potential Vsig (video writing potential) of the video voltage signal VSIG and the potential Vini (initialization potential) of the initialization voltage signal; and the threshold voltage Vth unique to that drive transistor 92. In this case, currents corresponding to voltages proportional to the potential differences (Vsig−Vini) flow through the drive transistors 92, and do not depend on variations in threshold voltage Vth of the drive transistors 92. These drive currents are supplied to the organic light-emitting diodes 90 via the drive transistors 92, and the organic light-emitting diodes 90 emit light in accordance with the drive currents, thereby enabling display with tones in the individual pixels 50.

At the same time, the power supply line 76 that supplies the drive potential $V_{DD}$ from the drive power supply PVDD (power supply circuit 60) to the pixels 50, and the power supply line 74 that supplies the reference potential $V_{SS}$ from the reference power supply PVSS (power supply circuit 58) to the pixels 50 supply power to all of the pixels 50 in the display area 38, and therefore have larger amounts of current flowing therethrough than the other wires. Therefore, the drive potential $V_{DD}$ and the reference potential $V_{SS}$ for the respective pixel columns and each pixel 50 change by influences from the wiring resistance of the power supply line 76 and the power supply line 74. In general, the power supply line 74 that supplies the reference potential $V_{SS}$ to the pixels 50 from the reference power supply PVSS (power supply circuit 58) is often made as solid wiring spanning the entire region of the display area 38. In such a case, the influence of the wiring resistance of the power supply line 74 over variations in the reference potential $V_{SS}$ is smaller than the influence of the wiring resistance of the power supply line 76 over variations in the drive potential $V_{DD}$.

In the comparative example illustrated in FIG. 5, after the capacitance 91 and the holding capacitance 98 are charged, substantially no current flows through the wiring, so that a fixed potential is supplied to all of the pixels 50 as the potential Vini (initialization potential) of the initialization voltage signal VINI. At the same time, large currents flow through the drive potential $V_{DD}$ and the reference potential $V_{SS}$, whereby voltage drops because of wiring resistance. As a result, the drain-source voltages Vds of the drive transistors 92 in the pixels that are more distant from the drive power supply PVDD (power supply circuit 60) and the reference power supply PVSS (power supply circuit 58) become relatively low. Consequently, because of the channel length modulation effect, smaller amounts of current flows through these drive transistors 92.

Therefore, when the drive potential $V_{DD}$ and the reference potential $V_{SS}$ are supplied from both of the opposite sides of the upper part of the display area 38 in FIG. 6, the drain-source voltages Vds of the drive transistors 92 are relatively low in the central portion in the X direction (first direction) on the screen of the display area 38 and in the lower side of FIG. 6 in the Y direction (second direction).

In particular, when raster display that is monochromatic (for example, red, green, blue, cyan, magenta, or white) is performed on the display area 38, luminance non-uniformity attributable to the drive potential $V_{DD}$ and the reference potential $V_{SS}$ is more likely to be visually observed than otherwise. Specifically, luminance at a location close to locations from which power is fed to the drive potential $V_{DD}$ and the reference potential $V_{SS}$ is relatively low as compared with luminance at a location distant from the locations from which power is fed to the drive potential $V_{DD}$ and the reference potential $V_{SS}$ (see FIG. 6).

Figure 7:
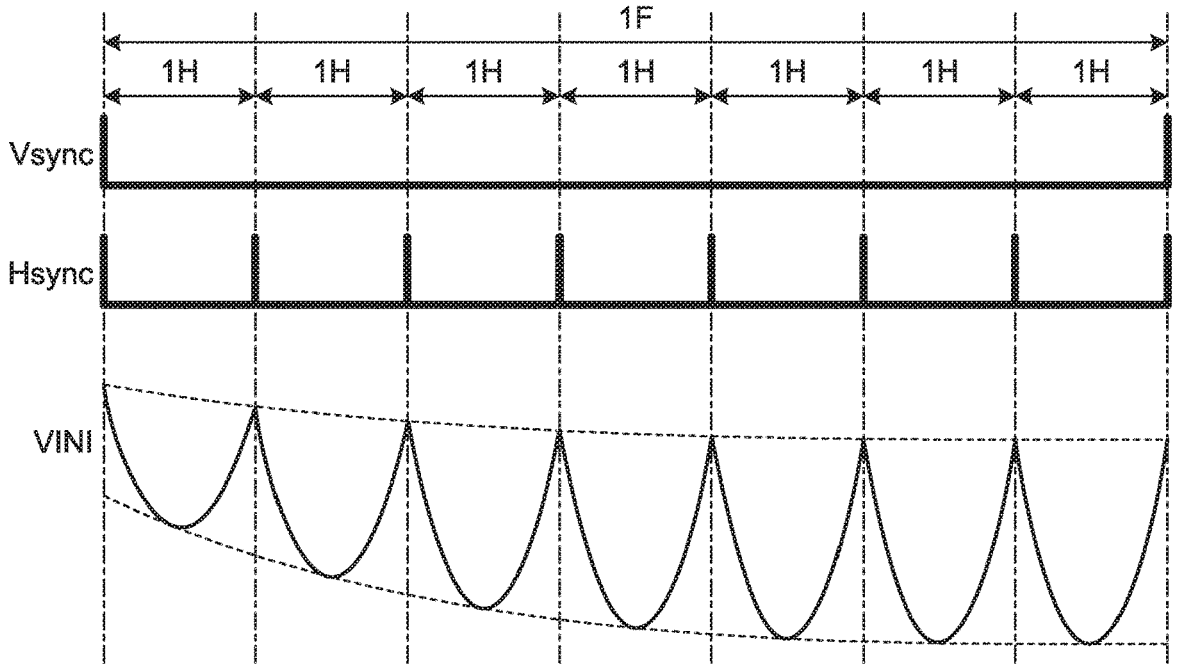
FIG. 7 is a diagram illustrating an example of an initialization voltage signal generated by an initialization signal generating circuit in the display device according to the first embodiment.

In contrast to this configuration, the display device 30 according to the present embodiment has a configuration such that the initialization signal generating circuit 81 is included as the control circuit 20 as illustrated in FIG. 2. FIG. 7 is a diagram illustrating an example of an initialization voltage signal generated by an initialization signal generating circuit in the display device according to the first embodiment. In the example illustrated in FIG. 7, a line connecting peak values of the initialization voltage signal VINI is depicted in a broken line.

FIG. 7 illustrates an example of an initialization voltage signal for correcting luminance non-uniformity in the X direction (first direction) and the Y direction (second direction) on the screen of the display area 38. That is, in the example illustrated in FIG. 7, the initialization voltage signal VINI obtained by synthesizing two signals is generated, the two signals being: one that gradually diminishes the initialization voltage signal VINI for a one-frame period (1F) of a video signal; and one that makes the initialization voltage signal VINI relatively high at the opposite ends of each horizontal scan period (1H) and lower in a location nearer to the center thereof. As a result, it is possible to suppress luminance non-uniformity that accompanies voltage drops in the drive potential $V_{DD}$ and the reference potential $V_{SS}$ that are attributable to the locations from which power is fed to the drive potential $V_{DD}$ and the reference potential $V_{SS}$. Specifically, the potential Vini (initialization potential) of the initialization voltage signal VINI is set smaller for a pixel more distant from power feeding units for the drive power supply PVDD (power supply circuit 60) and the reference power supply PVSS (power supply circuit 58). Thus, for the pixel in which the drain-source voltage Vds of the drive transistor 92 is lower, the potential Vini (initialization potential) of the initialization voltage signal VINI to be supplied is lowered, and the potential difference (Vsig−Vini) between the potential Vsig (video writing potential) of the video voltage signal VSIG to be supplied to the drive transistor 92 and the potential Vini (initialization potential) of the initialization voltage signal VINI is enlarged. This example thereby aims at correcting currents that flow through the drive transistors 92.

Figure 8:
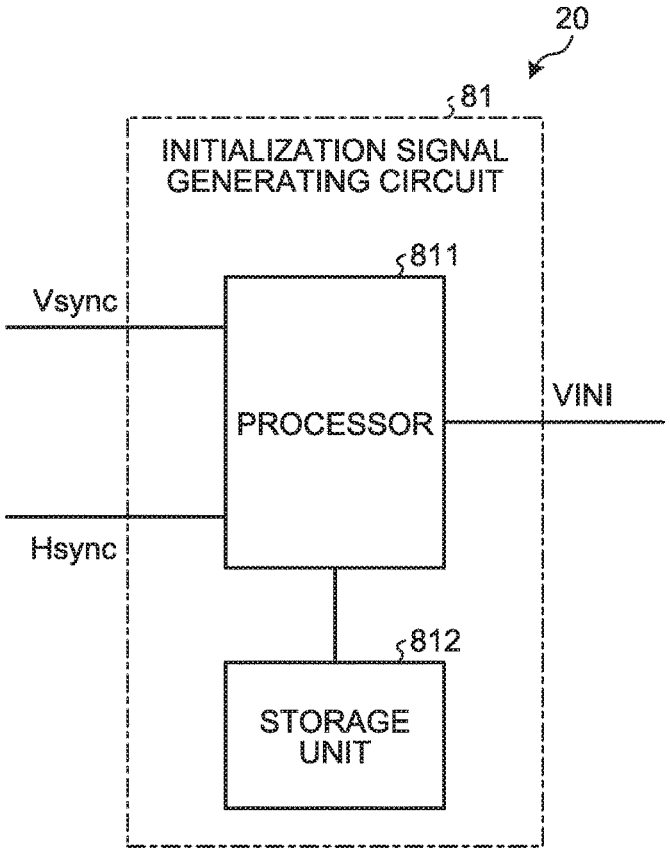
FIG. 8 is a diagram illustrating an example of a schematic block configuration of an initialization signal generating circuit in the display device according to the first embodiment.

FIG. 8 is a diagram illustrating an example of a schematic block configuration of an initialization signal generating circuit in the display device according to the first embodiment.

As illustrated in FIG. 8, a vertical synchronization signal Vsync and a horizontal synchronization signal Hsync of a video signal are input from the controller 56 to the initialization signal generating circuit 81 of the control circuit 20. The initialization signal generating circuit 81 includes a processor 811 and a storage unit 812.

Figure 9:
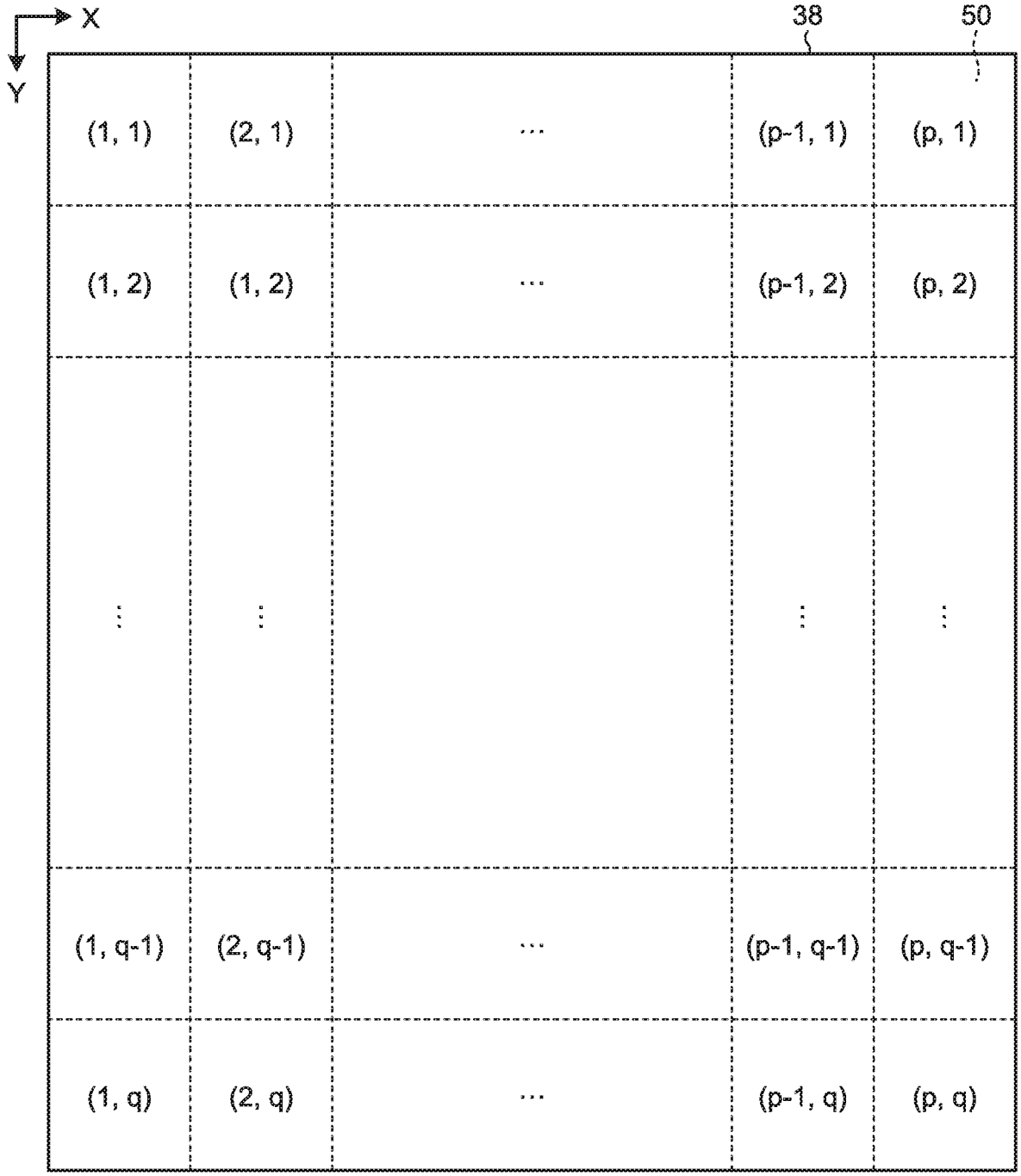
FIG. 9 is a diagram illustrating an arrangement example of pixels in the display area.

FIG. 9 is a diagram illustrating an example arrangement of pixels in the display area. FIG. 9 illustrates an example in which, while p pixels 50 (p is an integer of at least 1) are arrayed next to one another in the X direction (first direction), q pixels 50 (q is an integer of at least 1) are arrayed next to one another in the Y direction (second direction). FIG. 10 is a diagram illustrating an example of correction coefficient value information including a correction coefficient value for each pixel.

While having data values for initial potentials Vinf of the initialization voltage signals VINI stored therein, the storage unit 812 has correction coefficient values illustrated in FIG. 9 for the respective pixels 50 stored therein as correction coefficient value information 8121 illustrated in FIG. 10.

It is assumed that, as the correction coefficient values stored as the correction coefficient value information 8121 for the respective pixels 50, values by which an image to be displayed on the display area 38 can have substantially uniform luminance are previously set at a time such as when the display device 30 is inspected before shipping with a monochrome raster displayed in which the potentials Vsig (video writing potentials) of the video voltage signals VSIG to be written into the respective pixels 50 are the same. A method for finding the correction coefficient values stored as the correction coefficient value information 8121 for the respective pixels 50 is not limited to this example. The correction coefficient values for the respective pixels 50 may be numeric data or may be discrete values such as digital data.

The processor 811 reads out the correction coefficient values for the pixels 50 from the correction coefficient value information 8121 stored in the storage unit 812 and corrects the data value of the initial potential Vinf of the initialization voltage signal VINI with respect to each pixel 50 based on the vertical synchronization signal Vsync and the horizontal synchronization signal Hsync that are input from the controller 56, thereby generating data values of the potentials Vini (initialization potentials) of the initialization voltage signals VINI. The present disclosure is not limited by a method by which the processor 811 calculates the potentials Vini (initialization potentials) of the initialization voltage signals VINI for the respective pixels 50. For example, a configuration such that the potentials Vini (initialization potentials) of the initialization voltage signals VINI for the respective pixels 50 are calculated by multiplying the initial potential Vinf of the initialization voltage signals VINI by the correction coefficient values for the respective pixels 50 may be employed. Alternatively, for example, a configuration such that the potentials Vini (initialization potentials) of the initialization voltage signals VINI for the respective pixels 50 are calculated by adding the correction coefficient values for the respective pixels 50 to the initial potential Vinf of the initialization voltage signals VINI may be employed.

The initialization voltage signals VINI generated in the above manner are output to the video line drive circuit 54. During the reset operation and the offset cancelling operation, the video line drive circuit 54 converts the data values of the potentials Vini (initialization potentials) of the initialization voltage signals VINI through a D/A converter into analog voltages and sequentially outputs the analog voltages from pixel row to pixel row.

As described above, the display device 30 according to the first embodiment includes the display area 38, which has the multiple pixels 50 arranged in the X direction (first direction) and the Y direction (second direction), and the control circuit 20. Each of the pixels 50 includes a light-emitting element (the organic light-emitting diode 90), which emits light with a current flowing therethrough, the drive transistor 92, and the holding capacitance 98. One of the terminals (the anode) of the light-emitting element (organic light-emitting diode 90) is coupled to one of the source and the drain of the drive transistor 92. A first potential (the reference potential $V_{SS}$) is supplied to the other terminal (the cathode) of the light-emitting element (organic light-emitting diode 90). A second potential (the drive potential $V_{DD}$), which is higher than the first potential (reference potential $V_{SS}$), is supplied to the other one of the source and the drain of the drive transistor 92. The holding capacitance 98 is coupled between the source and the gate of the drive transistor 92. After writing an initialization potential (the potential Vini of the initialization voltage signal VINI) into the gate of the drive transistor 92, the control circuit 20 writes a video writing potential (the potential Vsig of the video voltage signal VSIG) resulting from a video signal into the gate of the drive transistor 92. As a result, a voltage that is a sum of a voltage proportional to the difference between the video writing potential (potential Vsig of the video voltage signal VSIG) and the initialization potential (potential Vini of the initialization voltage signal VINI) and a threshold voltage of the drive transistor 92 is set across the holding capacitance 98. Throughout the emission period $P_{EM}$ of the light-emitting element (organic light-emitting diode 90), a current corresponding to a voltage proportional to the difference between the video writing potential (potential Vsig of the video voltage signal VSIG) and the initialization potential (potential Vini of the initialization voltage signal VINI) flows through the light-emitting element (organic light-emitting diode 90). In this configuration, the control circuit 20 sets the initialization potentials (potentials Vini of the initialization voltage signals VINI) for the respective pixels 50.

Specifically, the control circuit 20 sets up the initialization potentials (potentials Vini of the initialization voltage signals VINI) in accordance with voltages across the drains and the sources of the corresponding drive transistors 92.

More specifically, the initialization signal generating circuit 81 of the control circuit 20 generates the potentials Vini (initialization potentials) to be supplied to the respective pixels 50 so that if the potentials Vsig (video writing potentials) of the video voltage signals VSIG to be written into the respective pixels 50 are the same, an image to be displayed on the display area 38 by the potentials Vsig (video writing potentials) of the video voltage signals VSIG can have substantially uniform luminance in the X direction (first direction) and the Y direction (second direction).

At this time, the initialization signal generating circuit 81 supplies the different potentials Vini (initialization potentials) to the respective pixels 50.

Thus, luminance non-uniformity in the X direction (first direction) and the Y direction (second direction) on the screen of the display area 38 can be suppressed.

Second Embodiment

The following describes a display device according to a second embodiment with a focus on differences thereof with the first embodiment while assigning the same reference signs to components thereof that have the same functions as those in the first embodiment described above and omitting descriptions of the components.

Figure 11:
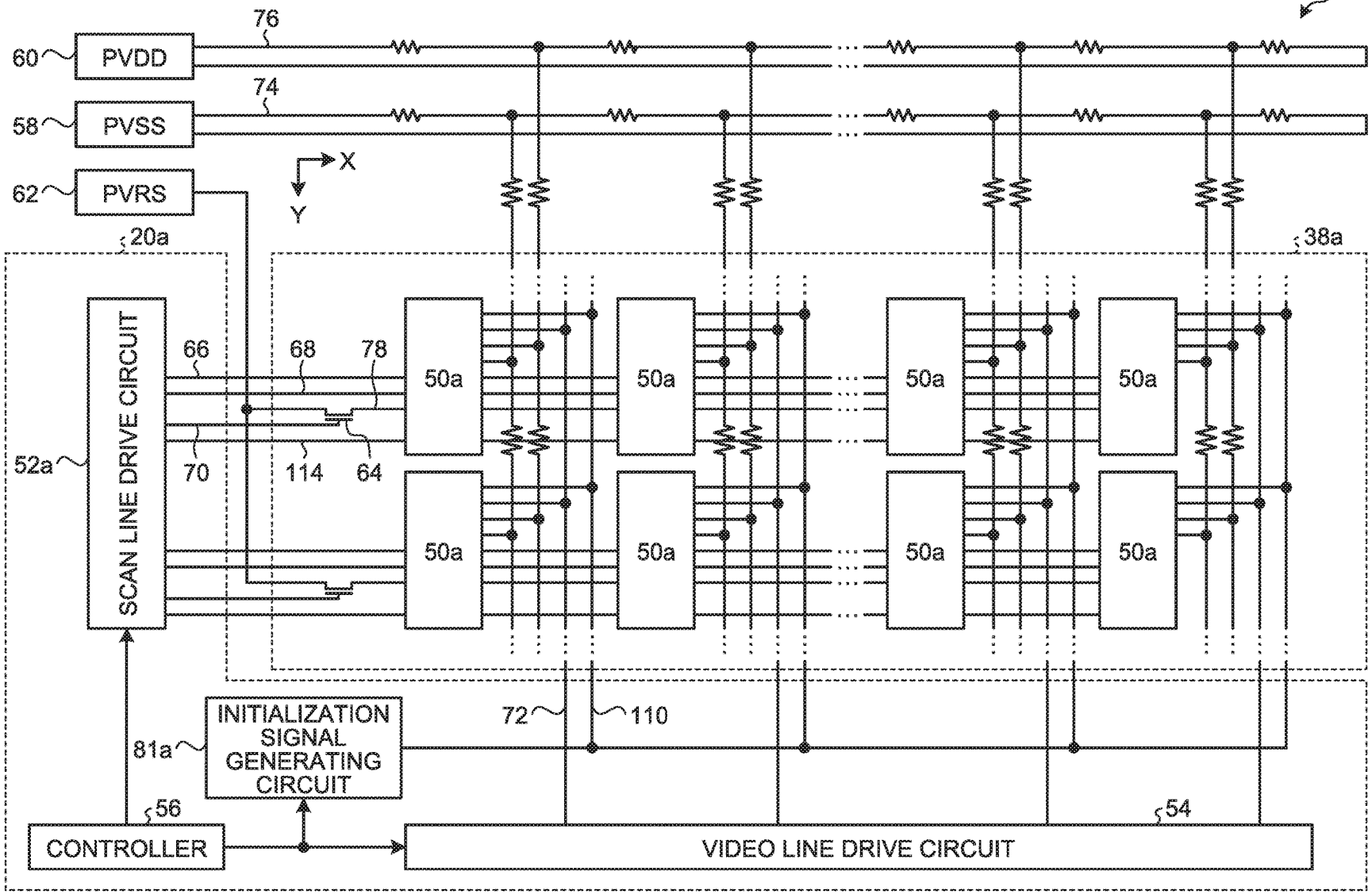
FIG. 11 is a schematic circuit diagram illustrating a schematic configuration of a display area and a control circuit of a display device according to a second embodiment.
Figure 12:
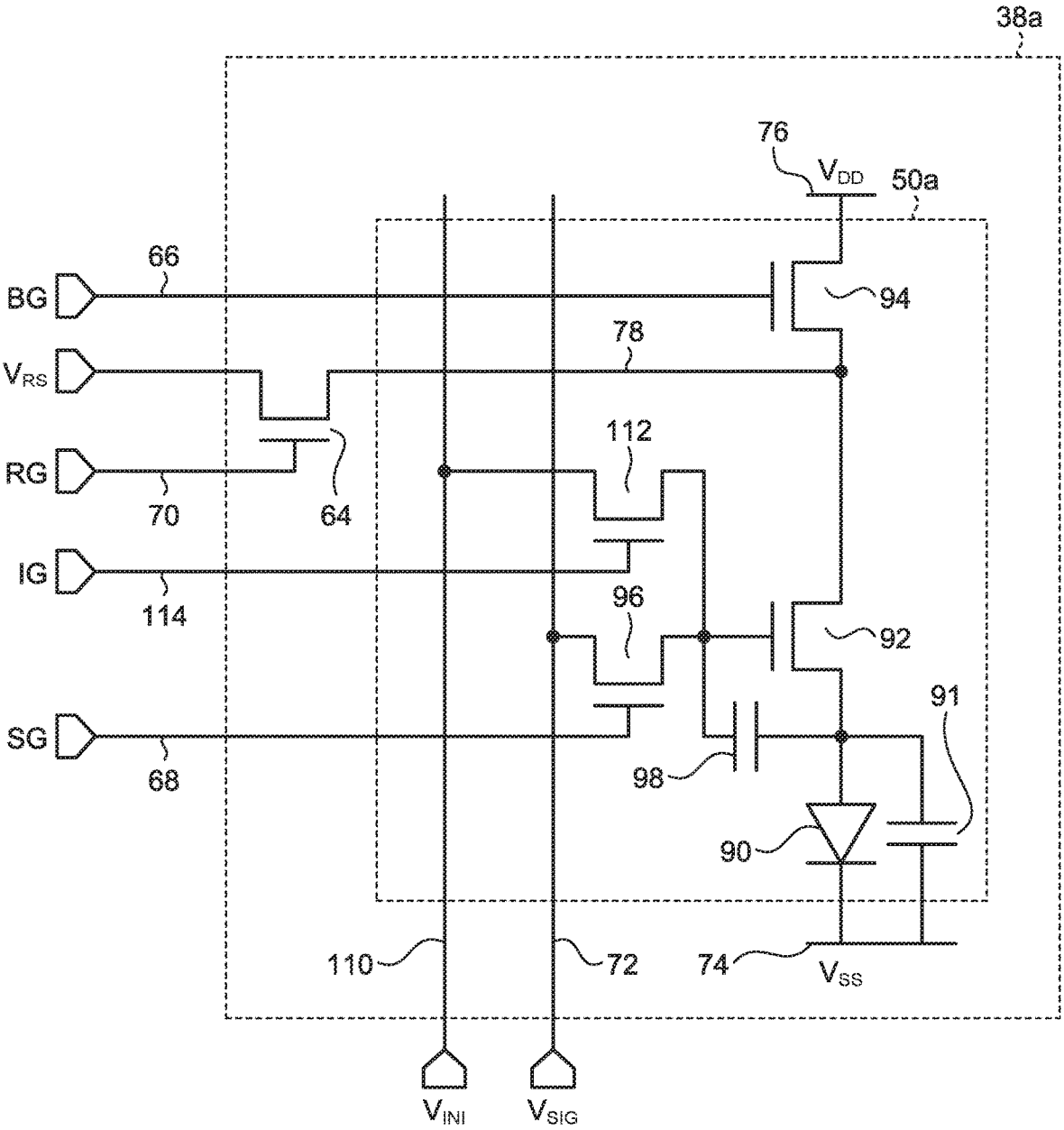
FIG. 12 is an example of a schematic equivalent circuit diagram of a pixel arranged in the display area illustrated in FIG. 11.

FIG. 11 is a schematic circuit diagram illustrating schematic configurations of the display area and a control circuit in the display device according to the second embodiment. FIG. 12 is an example of a schematic equivalent circuit diagram of a pixel arranged in the display area illustrated in FIG. 11.

A display device 30*a* illustrated in FIG. 11 according to the second embodiment is different from the first embodiment illustrated in FIG. 2 in that video voltage signals VSIG and initialization voltage signals VINI are supplied in different lines. Specifically, wiring to pixels 50*a* include not only the video signal lines (first signal lines) 72 that supply the video voltage signals VSIG but also initialization signal lines 110 (second signal lines) that supply the initialization voltage signals VINI.

In the present embodiment, each pixel row is coupled in common to one of the initialization signal lines (second signal line) 110 that supplies the initialization voltage signal VINI thereto.

The pixel circuit illustrated in FIG. 12 includes an initialization switch 112. While one current terminal of the initialization switch 112 is coupled to the gate of the drive transistor 92, the other current terminal thereof is coupled to the corresponding initialization signal line (second signal line) 110. The initialization switch 112 receives an initialization control signal IG applied to the gate electrode thereof from a scan line drive circuit 52*a*, and switches between coupling and decoupling of the gate electrode of the drive transistor 92 to and from the initialization signal line (second signal line) 110. Initialization control lines 114 that supply the initialization control signals IG are provided to the respective pixel rows and each control all of the initialization switches 112 together in the corresponding pixel row. The initialization switch 112 is formed of an n-type TFT as with the drive transistor 92, the lighting switch 94, the reset switch 64, and the writing switch 96.

The present embodiment represents an example in which the initialization switch 112 is formed of an n-type TFT but is not limited thereto. For example, the initialization switch 112 may be a p-type TFT. Hereinbelow, a case in which the initialization switch 112 is an n-type TFT is illustrated.

The scan line drive circuit 52*a* supplies the initialization control signals IG to the respective initialization control lines 114.

Figure 13:
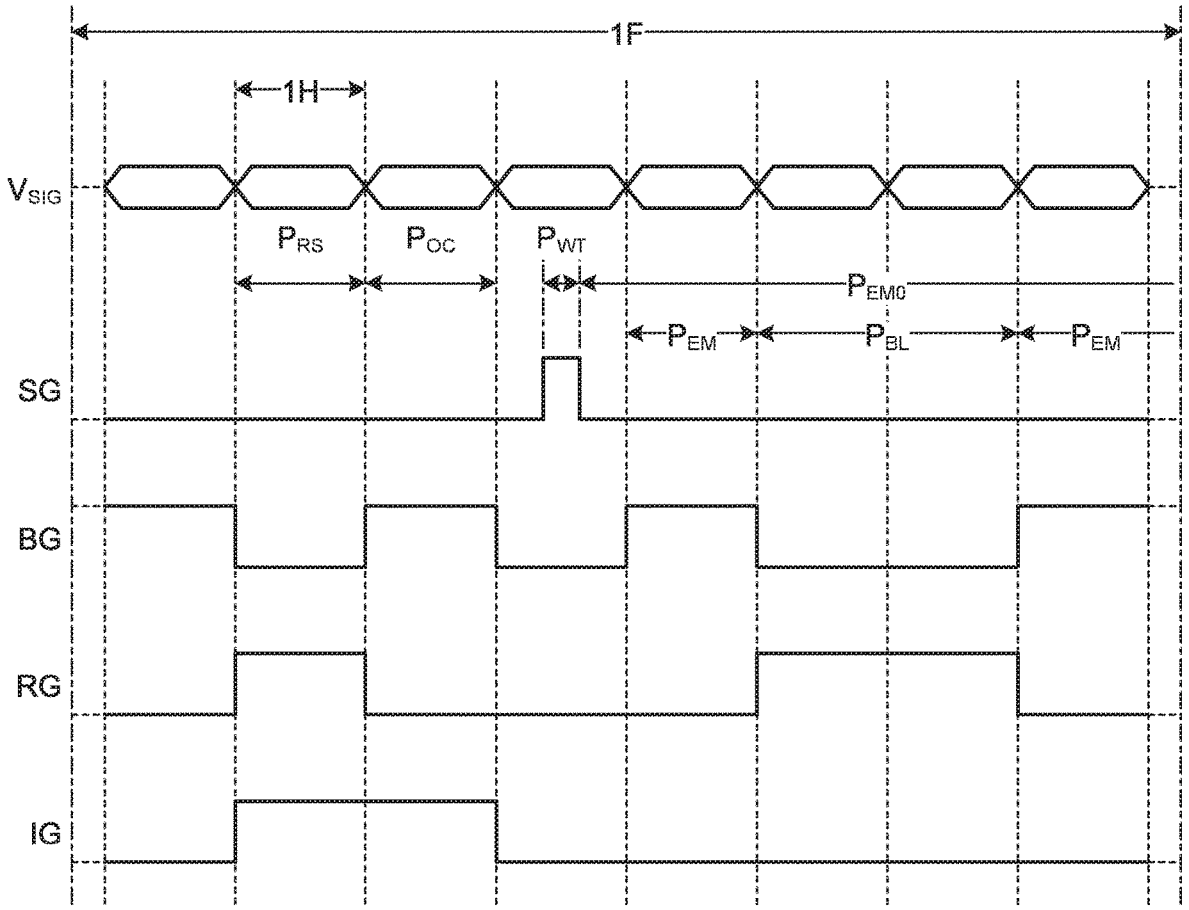
FIG. 13 is a schematic timing chart for explaining a driving method for the display device according to the second embodiment.

FIG. 13 is a schematic timing chart for explaining a driving method for the display device according to the second embodiment. As with FIG. 4, FIG. 13 illustrates: the writing operation of the pixel value in one pixel row of a display area 38*a*; and changes of various signals in the emission operation. FIG. 13 includes, among the various signals, the initialization control signal IG in addition to those included in FIG. 4.

As with the first embodiment, writing operation is performed to write the potential Vsig (video writing potential) of the video voltage signal VSIG to each pixel 50*a*, and emission operation is then performed to cause the corresponding organic light-emitting diode 90 to emit light with intensity according to the potential Vsig (video writing potential) of the video voltage signals VSIG.

Specifically, in reset operation, the lighting switch 94 is turned off by setting the lighting control signal BG to the L level, the reset switch 64 is turned on by setting the reset control signal RG to the H level, and further, the initialization switch 112 is turned on by setting the initialization control signal IG to the H level with the potentials Vini (initialization potentials) of the initialization voltage signals VINI applied to the respective initialization signal lines (second signal lines) 110.

As a result, the potential corresponding to the potential Vini (initialization potential) of the initialization voltage signal VINI is applied to the gate potential of the drive transistor 92, and a voltage corresponding to the reset potential is applied to the anode electrode side of the organic light-emitting diode 90. As a result, the source potential of the drive transistor 92 is reset to a potential corresponding to the reset potential $V_{RS}$, and the terminal-to-terminal voltage of the holding capacitance 98 of each pixel 50 is set to a voltage corresponding to ($Vini-V_{RS}$). The voltage applied to the organic light-emitting diode 90 reaches a voltage corresponding to ($V_{RS}-V_{SS}$), and the reset potential $V_{RS}$ is set so that this voltage can be lower than or equal to an emission threshold voltage (light emission starting voltage) of the organic light-emitting diode 90.

Specifically, in offset cancelling operation, the reset switch 64 is turned off by setting the reset control signal RG to the L level with the initialization switch 112 kept on, and the lighting switch 94 is turned on by setting the lighting control signal BG to the H level.

As a result, the gate potential of the drive transistor 92 is fixed at a potential corresponding to the potential Vini (initialization potential) of the initialization voltage signal VINI. Because the lighting switch 94 is on, a current flows into the drive transistor 92 from the drive power supply PVDD, so that the source potential of the drive transistor 92 rises from the reset potential $V_{RS}$ that has been written during the reset period PRS. When the source potential reaches a potential (Vini−Vth) that is Vth lower than the gate potential, the drive transistor 92 becomes non-conductive, so that while the source potential of the drive transistor 92 is fixed at the potential (Vini−Vth), the terminal-to-terminal voltage of the holding capacitance 98 is set to a voltage corresponding to the threshold voltage Vth of the drive transistor 92.

On the basis of this state, the lighting switch 94 is turned off by setting the lighting control signal BG to the L level, so that a current is prevented from flowing into the drive transistor 92 from the drive power supply PVDD. The initialization switch 112 is turned off by setting the initialization control signal IG to the L level and, further, the writing switch 96 is turned on by setting the writing control signal SG to the H level with the potentials Vsig (video writing potentials) of the video voltage signals VSIG applied to the video signal lines (first signal lines) 72. As a result, the gate potential of the drive transistor 92 rises from the potential corresponding to the potential Vini (initialization potential) of the initialization voltage signal VINI to a potential corresponding to the potential Vsig (video writing potential) of the video voltage signal VSIG.

Upon completion of the video signal setting operation by having the writing switch 96 turned off, the emission-enabled period $P_{EM0}$ starts. For the display device 30*a*, the non-emission period $P_{BL}$ is set as a part of the emission-enabled period $P_{EM0}$ in addition to the emission period $P_{EM}$. Thus, black-screen insertion operation is performed. As in the first embodiment, throughout the emission period $P_{EM}$, the reset switch 64 is put off while the lighting switch 94 is put on. Throughout the non-emission period $P_{BL}$, the reset switch 64 is put on while the lighting switch 94 is put off. The initialization control signal IG that has been set to the L level during the video signal setting period $P_{WT}$ is continuously maintained at the L level after the start of the emission-enabled period $P_{EM0}$.

In the present embodiment as in the first embodiment, throughout the non-emission period $P_{BL}$, the reset power supply PVRS (power supply circuit 62) is coupled to the reset lines 78 by setting the reset control signal RG to the H level, thereby having the reset switch 64 on.

Thus, even when there is a high-resistance short circuit between any one of the reset lines 78 and any other wiring, the drain of the drive transistor 92 is maintained at a potential corresponding to the reset potential $V_{RS}$, and the organic light-emitting diode 90 is consequently prevented from emitting light. Therefore, phenomena such as disappearance of a horizontal line and emergence of a horizontal seam on the screen of the display area 38*a* can be prevented from occurring when the high-resistance short circuit causes the pixels 50*a* that are coupled in common to the one of the reset line 78 to emit light.

Figure 14:
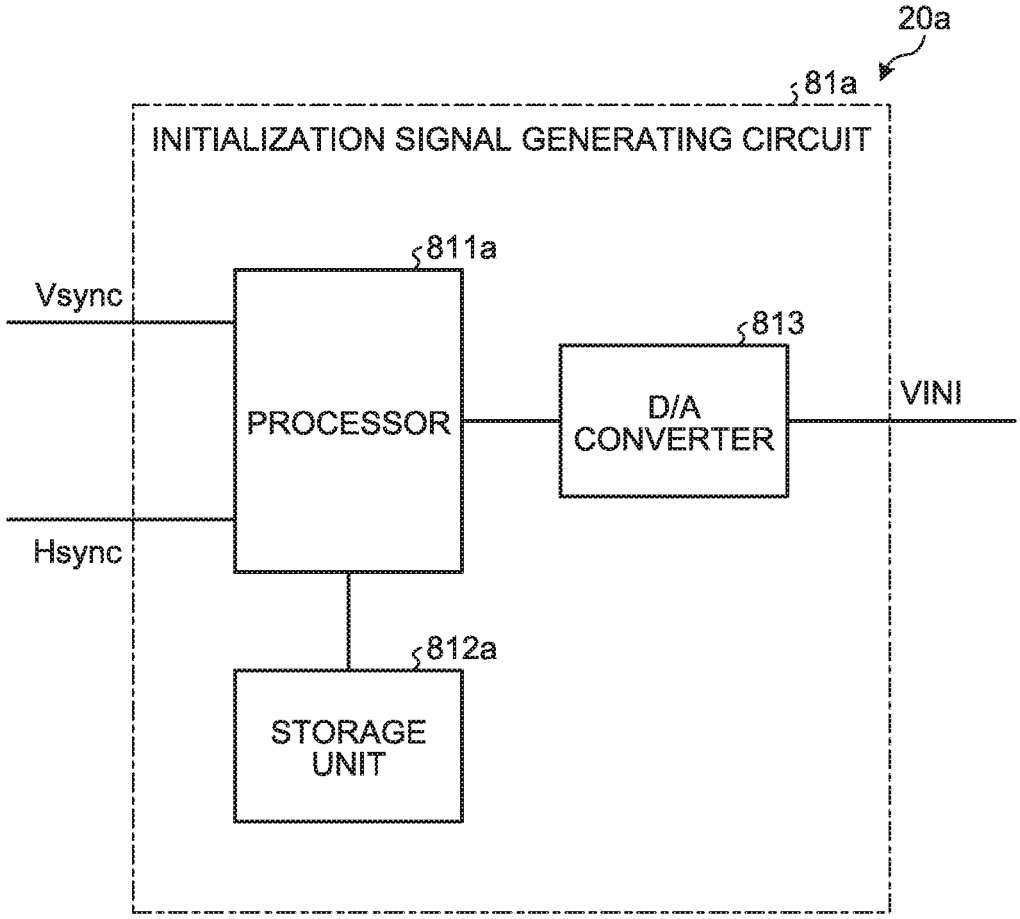
FIG. 14 is a diagram illustrating an example of a schematic block configuration of an initialization signal generating circuit in the display device according to the second embodiment.

FIG. 14 is a diagram illustrating an example of a schematic block configuration of an initialization signal generating circuit in the display device according to the second embodiment.

As illustrated in FIG. 14, a vertical synchronization signal Vsync and a horizontal synchronization signal Hsync of a video signal are input from the controller 56 to an initialization signal generating circuit 81*a* of a control circuit 20*a* as in the first embodiment. The initialization signal generating circuit 81*a* includes a processor 811*a*, a storage unit 812*a*, and a digital-to-analog (D/A) converter 813.

As illustrated above, in the present embodiment, each pixel row is coupled in common to one of the initialization signal lines (second signal line) 110 that supplies the initialization voltage signal VINI thereto. Therefore, in the present embodiment, the processor 811*a* generates the initialization voltage signal VINI that each pixel row receives in common.

Figure 15:
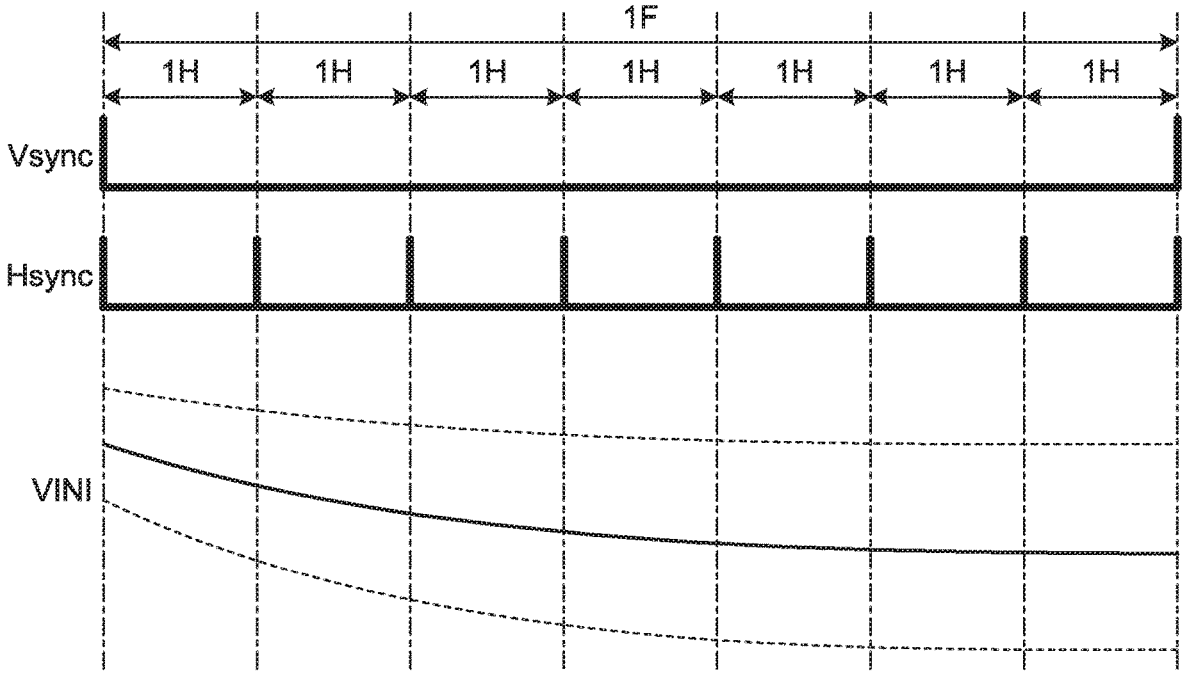
FIG. 15 is a diagram illustrating an example of an initialization voltage signal generated by an initialization signal generating circuit in the display device according to the second embodiment.

FIG. 15 is a diagram illustrating an example of the initialization voltage signal generated by the initialization signal generating circuit in the display device according to the second embodiment. In the example illustrated in FIG. 15, a line connecting peak values of the initialization voltage signal VINI illustrated in FIG. 7 is depicted in a broken line.

FIG. 15 illustrates an example of the initialization voltage signal for correcting luminance non-uniformity in the Y direction (second direction) out of luminance non-uniformity in the X direction (first direction) and the Y direction (second direction) on the screen of the display area 38*a*. That is, in the example illustrated in FIG. 15, data values such that the potential Vini (initialization potential) of the initialization voltage signal VINI is gradually decreased for each One-frame period (1F) of a video signal are generated for the potential Vini (initialization potential) of the initialization voltage signal VINI. As a result, it is possible to suppress luminance non-uniformity in the Y direction (second direction) that accompanies voltage drops in the drive potential $V_{DD}$ and the reference potential $V_{SS}$ that are attributable to the locations from which power is fed to the drive potential $V_{DD}$ and the reference potential $V_{SS}$.

Figure 16:
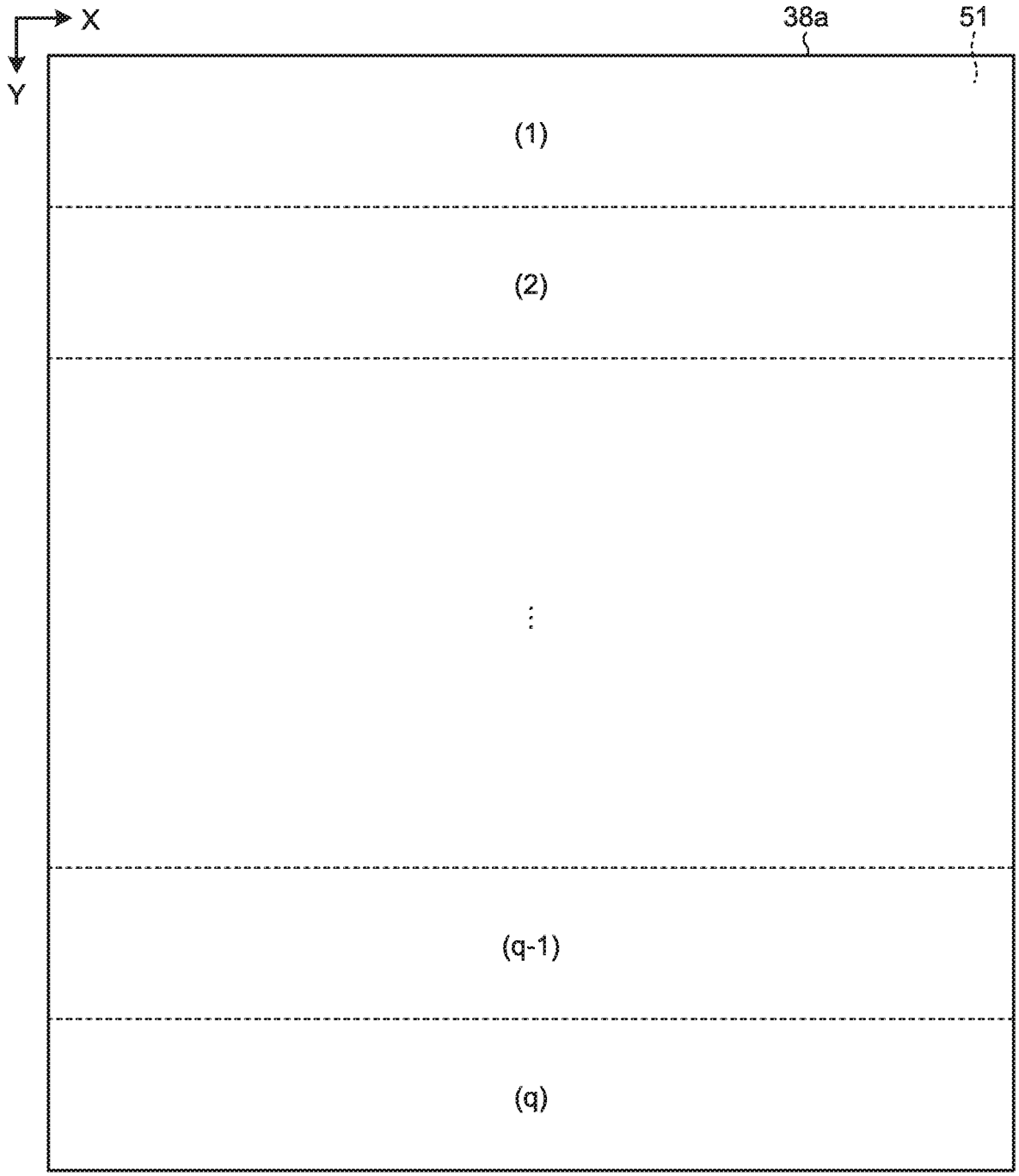
FIG. 16 is a diagram illustrating an arrangement example of pixels in the display area.

FIG. 16 is a diagram illustrating an arrangement example of pixels in the display area. FIG. 16 illustrates an example in which q pixel rows 51 (q is an integer of at least 1) are arrayed next to one another in the Y direction (second direction). FIG. 17 is a diagram illustrating an example of correction coefficient value information including a correction coefficient value for each pixel row.

While having the initial potentials Vinf of the initialization voltage signal VINI stored therein, the storage unit 812*a* has correction coefficient values illustrated in FIG. 16 for the respective pixel rows 51 stored therein as correction coefficient value information 8121*a* illustrated in FIG. 17.

It is assumed that, as the correction coefficient values stored as the correction coefficient value information 8121*a* for the respective pixel rows 51, values by which an image to be displayed on the display area 38*a* can have substantially uniform luminance in the Y direction (second direction) are previously set at a time such as when the display device 30 is inspected before shipping with a monochrome raster displayed in which the potentials Vsig (video writing potentials) of the video voltage signals VSIG to be written into the respective pixels 50 are the same. A method for finding the correction coefficient values stored as the correction coefficient value information 8121*a* for the respective pixel rows 51 is not limited to this example. The correction coefficient values for the respective pixel rows 51 may be numeric data or may be discrete values such as digital data.

The processor 811*a* reads out the correction coefficient values for the respective pixel rows 51 from the correction coefficient value information 8121*a* stored in the storage unit 812*a* and corrects the data value of the initial potential Vinf of the initialization voltage signal VINI with respect to each pixel row 51 based on the vertical synchronization signal Vsync and the horizontal synchronization signal Hsync that are input from the controller 56, thereby generating data values of the potentials Vini (initialization potentials) of the initialization voltage signals VINI. The present disclosure is not limited by a method by which the processor 811*a* calculates the potentials Vini (initialization potentials) of the initialization voltage signals VINI for the respective pixel rows 51. For example, a configuration such that the potentials Vini (initialization potentials) of the initialization voltage signals VINI for the respective pixel rows 51 are calculated by multiplying the initial potential Vinf of the initialization voltage signals VINI by the correction coefficient values for the respective pixel rows 51 may be employed. Alternatively, for example, a configuration such that the potentials Vini (initialization potentials) of the initialization voltage signals VINI for the respective pixel rows 51 are calculated by adding the correction coefficient values for the respective pixel rows 51 to the initial potential Vinf of the initialization voltage signals VINI may be employed.

During the reset operation and the offset cancelling operation, the D/A converter 813 converts the data values of the initialization voltage signals VINI into analog voltages and sequentially outputs the analog voltages to the initialization signal lines (second signal lines) 110.

As described above, the initialization signal generating circuit 81*a* of the control circuit 20*a* according to the second embodiment generates the potentials Vini (initialization potentials) to be supplied to the respective pixels 50*a* so that if the potentials Vsig (video writing potentials) of the video voltage signals VSIG to be written into the pixels 50*a* are the same, an image to be displayed on the display area 38*a* by the potentials Vsig (video writing potentials) of the video voltage signals VSIG can have substantially uniform luminance in the Y direction (second direction).

At this time, the initialization signal generating circuit 81*a* supplies the same potential Vini (initialization potentials) to the pixels 50*a* that are arrayed next to each other in the X direction (first direction).

Thus, luminance non-uniformity in the Y direction (second direction) out of luminance non-uniformity in the X direction (first direction) and the Y direction (second direction) on the screen of the display area 38*a* can be suppressed.

The present embodiment can reduce the size of information for the correction coefficient value information as compared to the first embodiment in which the correction coefficient values are set for the respective pixels 50. Therefore, the storage unit 812*a* is allowed to have a smaller storage capacity than in the first embodiment.

In the present embodiment, the amount of processing to be performed by the processor 811*a* can be smaller than in the first embodiment in which the potentials Vini (initialization potentials) of the initialization voltage signals VINI are calculated for the respective pixels 50.

It is alternatively possible to have the initialization switch 112 turned on in a time-divisional manner and supply the potentials Vini (initialization potentials) of the initialization voltage signals VINI to the respective pixels 50.

Third Embodiment

The following describes a display device according to a third embodiment with a focus on differences thereof with the first or the second embodiment while assigning the same reference signs to components thereof that have the same functions as those in the first or the second embodiment described above and omitting descriptions of the components.

Figure 18:
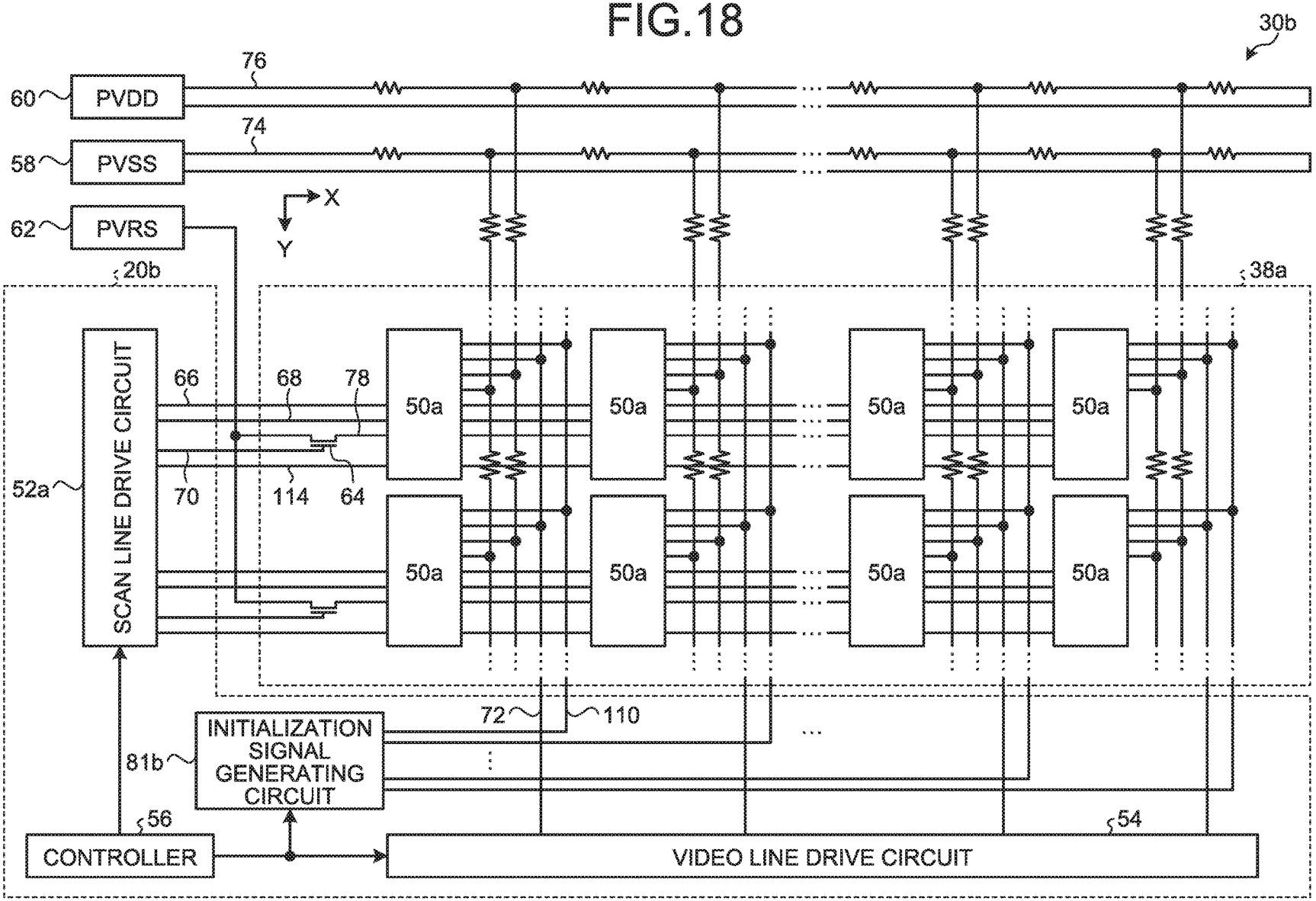
FIG. 18 is a schematic circuit diagram illustrating a schematic configuration of a display area and a control circuit of a display device according to a third embodiment.

FIG. 18 is a schematic circuit diagram illustrating schematic configurations of the display area and a control circuit in the display device according to the third embodiment. In the second embodiment, each pixel row is coupled in common to one of the initialization signal lines (second signal line) 110 that supplies the initialization voltage signal VINI thereto. The present embodiment is different from the second embodiment in that the individual initialization signal lines (second signal lines) 110 that supply the initialization voltage signals VINI to the respective pixel rows are independent from each other. Thus, in the present embodiment, a configuration such that the potentials Vini (initialization potentials) of the initialization voltage signals VINI are calculated for the respective pixels 50*a* is employed as in the first embodiment.

Figure 19:
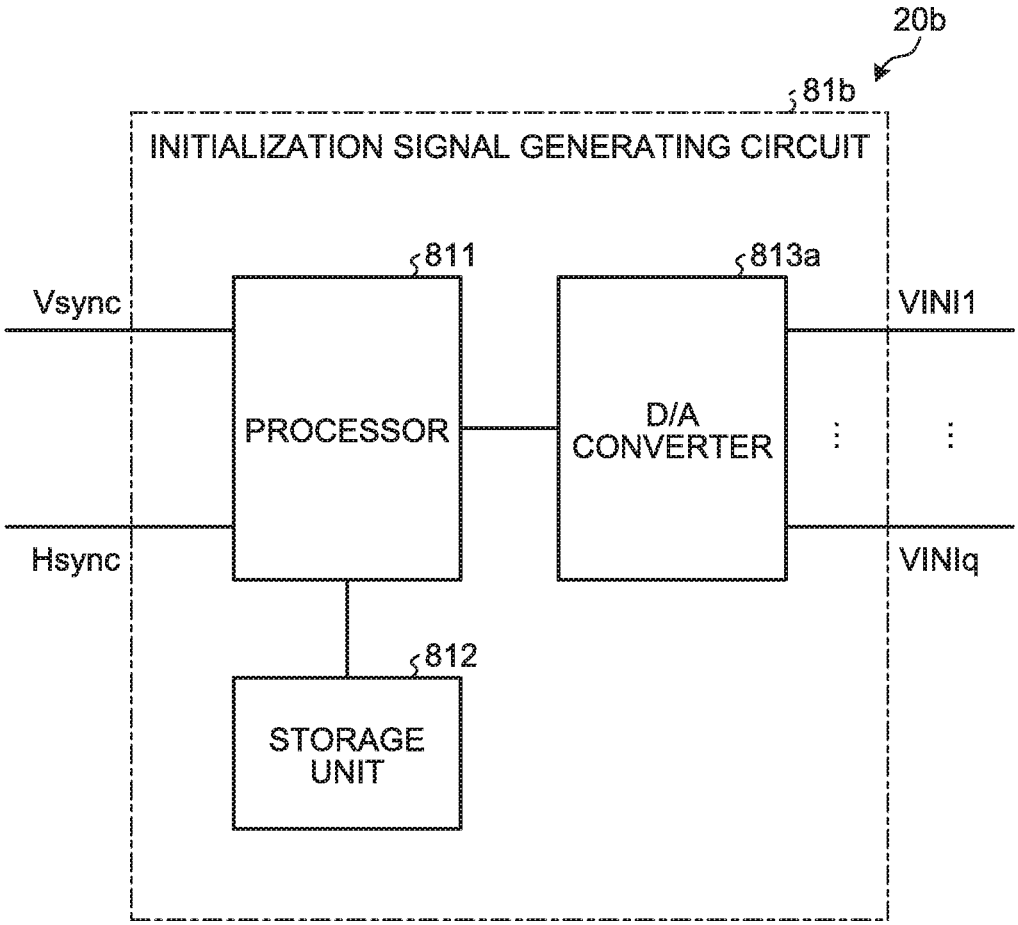
FIG. 19 is a diagram illustrating an example of a schematic block configuration of an initialization signal generating circuit in the display device according to the third embodiment.

FIG. 19 is a diagram illustrating an example of a schematic block configuration of an initialization signal generating circuit in the display device according to the third embodiment.

As illustrated in FIG. 19, a vertical synchronization signal Vsync and a horizontal synchronization signal Hsync of a video signal are input from the controller 56 to an initialization signal generating circuit 81*b* of a control circuit 20*b* in a display device 30*b* according to the third embodiment as in the first embodiment and in the second embodiment. The initialization signal generating circuit 81*b* includes the processor 811, the storage unit 812, and a D/A converter 813*a*.

During the reset operation and the offset cancelling operation, the D/A converter 813*a* converts the data values of the potentials Vini (initialization potentials) of the initialization voltage signals VINI into analog voltages and sequentially outputs the analog voltages to the respective initialization signal lines (second signal lines) 110 provided to the respective pixel rows.

As described above, the initialization signal generating circuit 81*b* of the control circuit 20*b* according to the third embodiment generates the potentials Vini (initialization potentials) to be supplied to the respective pixels 50*a* so that if the potentials Vsig (video writing potentials) of the video voltage signals VSIG to be written into the pixels 50*a* are the same, an image to be displayed on the display area 38*a* by the potentials Vsig (video writing potentials) of the video voltage signals VSIG can have substantially uniform luminance in the X direction (first direction) and the Y direction (second direction), as in the first embodiment.

At this time, the initialization signal generating circuit 81*b* supplies the different potentials Vini (initialization potentials) to the respective pixels 50*a*, as in the first embodiment.

Thus, luminance non-uniformity in the X direction (first direction) and the Y direction (second direction) on the screen of the display area 38 can be suppressed as in the first embodiment.

Fourth Embodiment

The following describes a display device according to a fourth embodiment with a focus on differences thereof with any of the first to the third embodiments while assigning the same reference signs to components thereof that have the same functions as those in any of the first to the third embodiments described above and omitting descriptions of the components.

In the present embodiment, an example is described in which the schematic configurations illustrated in FIG. 2 of the display area 38 and the control circuit 20 in the display device according to the first embodiment are altered so that the correction coefficient values can be set for respective pixel groups corresponding to a plurality of regions obtained by dividing the display area 38. In the present embodiment, the processing to be performed by the processor 811 and the correction coefficient value information stored in storage unit 812 are different from those in the initialization signal generating circuit 81 illustrated in FIG. 8.

Figure 20:
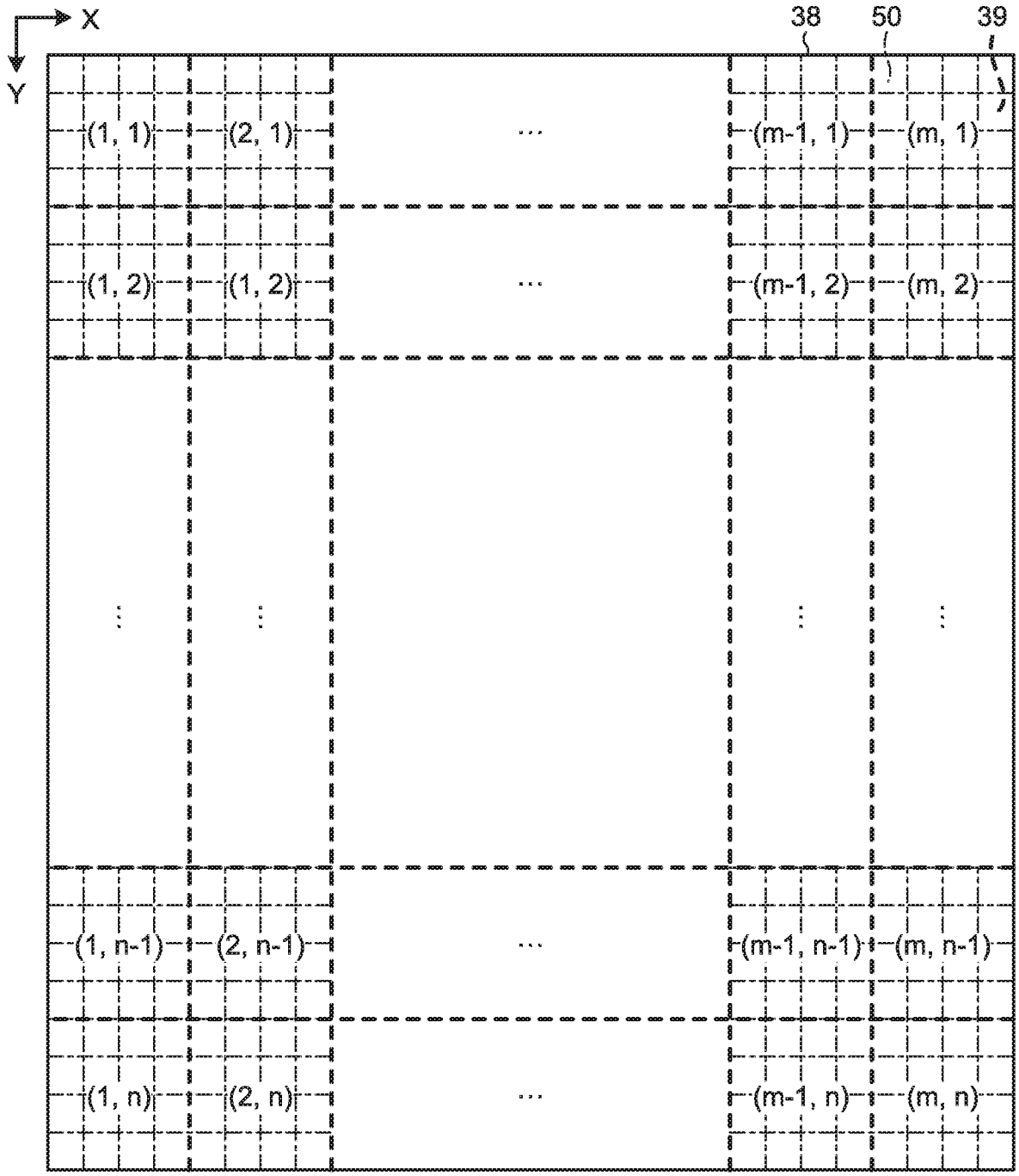
FIG. 20 is a diagram illustrating an arrangement example of pixel groups in the display area.

FIG. 20 is a diagram illustrating an arrangement example of pixel groups in the display area. FIG. 20 illustrates an example in which, while m pixel groups 39 (m is an integer of at least 1) each formed of a plurality of pixels 50 are arrayed next to one another in the X direction (first direction), n pixel groups 39 (n is an integer of at least 1) each formed of a plurality of pixels 50 are arrayed next to one another in the Y direction (second direction). While each of the pixel groups 39 is formed of four pixels 50 arrayed next to one another in the X direction (first direction) and the Y direction (second direction) in the example illustrated in FIG. 20, the numbers of the pixels 50 arrayed next to one another in the X direction (first direction) and the Y direction (second direction) in each of the pixel groups 39 are not limited to this example. FIG. 21 is a diagram illustrating an example of correction coefficient value information including a correction coefficient value for each pixel group.

While having data values for initial potentials Vinf of the initialization voltage signal VINI stored therein, the storage unit 812 has correction coefficient values illustrated in FIG. 20 for the respective pixel groups 39 stored therein as correction coefficient value information 8121*b* illustrated in FIG. 21.

It is assumed that: as the correction coefficient values stored as the correction coefficient value information 8121*b* for the respective pixel groups 39, values by which an image to be displayed on the display area 38 can have substantially uniform luminance are previously found at a time such as when the display device 30 is inspected before shipping with a monochrome raster displayed in which the potentials Vsig (video writing potentials) of the video voltage signals VSIG to be written into the respective pixels 50 are the same; and the average of the correction coefficient values for the respective pixels 50 included in each of the pixel groups 39 is previously set with respect to that pixel group 39. A method for finding the correction coefficient values stored as the correction coefficient value information 8121*b* for the respective pixel groups 39 is not limited to this example. For example, the correction coefficient value stored as the correction coefficient value information 8121*b* for each of the pixel groups 39 may be the average or a representative value of the correction coefficient values for the corresponding pixel groups 39 of a certain number of display devices 30. The correction coefficient values for the respective pixel groups 39 may be numeric data or may be discrete values such as digital data.

The processor 811 reads out the correction coefficient values for the respective pixel groups 39 from the correction coefficient value information 8121*b* stored in the storage unit 812 and corrects the initial potential Vinf of the initialization voltage signal VINI with respect to each pixel group 39 based on the vertical synchronization signal Vsync and the horizontal synchronization signal Hsync that are input from the controller 56, thereby generating data values of the potentials Vini (initialization potentials) of the initialization voltage signals VINI. The present disclosure is not limited by a method by which the processor 811 calculates the potentials Vini (initialization potentials) of the initialization voltage signals VINI for the respective pixel groups 39. For example, a configuration such that the potentials Vini (initialization potentials) of the initialization voltage signals VINI for the respective pixel groups 39 are calculated by multiplying the initial potential Vinf of the initialization voltage signals VINI by the correction coefficient values for the respective pixels 39 may be employed. Alternatively, for example, a configuration such that the potentials Vini (initialization potentials) of the initialization voltage signals VINI for the respective pixel group 39 are calculated by adding the correction coefficient values for the respective pixel groups 39 to the initial potential Vinf of the initialization voltage signals VINI may be employed.

The initialization voltage signals VINI generated in the above manner are output to the video line drive circuit 54. During the reset operation and the offset cancelling operation, the video line drive circuit 54 converts the data values of the potentials Vini (initialization potentials) of the initialization voltage signals VINI through a D/A converter into analog voltages and sequentially outputs the analog voltages from pixel row to pixel row.

The present embodiment can reduce the size of information for the correction coefficient value information as compared to the first embodiment in which the correction coefficient values are set for the respective pixels 50. Therefore, the storage unit 812 is allowed to have a smaller storage capacity than in the first embodiment.

In the present embodiment, the amount of processing to be performed by the processor 811 can be smaller than in the first embodiment in which the potentials Vini (initialization potentials) of the initialization voltage signals VINI are calculated for the respective pixels 50.

As described above, in the fourth embodiment, the initialization signal generating circuit 81 of the control circuit 20 generates the potentials Vini (initialization potentials) to be supplied to the respective pixels 50 so that if the potentials Vsig (video writing potentials) of the video voltage signals VSIG to be written into the multiple pixels 50 are the same, an image to be displayed on the display area 38 by the potentials Vsig (video writing potentials) of the video voltage signals VSIG can have substantially uniform luminance in the X direction (first direction) and the Y direction (second direction).

At this time, the initialization signal generating circuit 81 supplies the same potential Vini (initialization potentials) to the pixels 50 included in each of the pixel groups 39 corresponding to a plurality of regions obtained by dividing the display area 38.

Thus, luminance non-uniformity in the X direction (first direction) and the Y direction (second direction) on the screen of the display area 38*a* can be suppressed with a smaller storage capacity of the storage unit 812 and a smaller amount of processing to be performed by the processor 811 than in the first embodiment.

Fifth Embodiment

The following describes a display device according to a fifth embodiment with a focus on differences thereof with any of the first to the fourth embodiments while assigning the same reference signs to components thereof that have the same functions as those in any of the first to the fourth embodiments described above and omitting descriptions of the components.

In the present embodiment, an example is described in which the schematic configurations illustrated in FIG. 2 of the display area 38 and the control circuit 20 in the display device according to the first embodiment include an initialization signal generating circuit having a different configuration.

Figure 22:
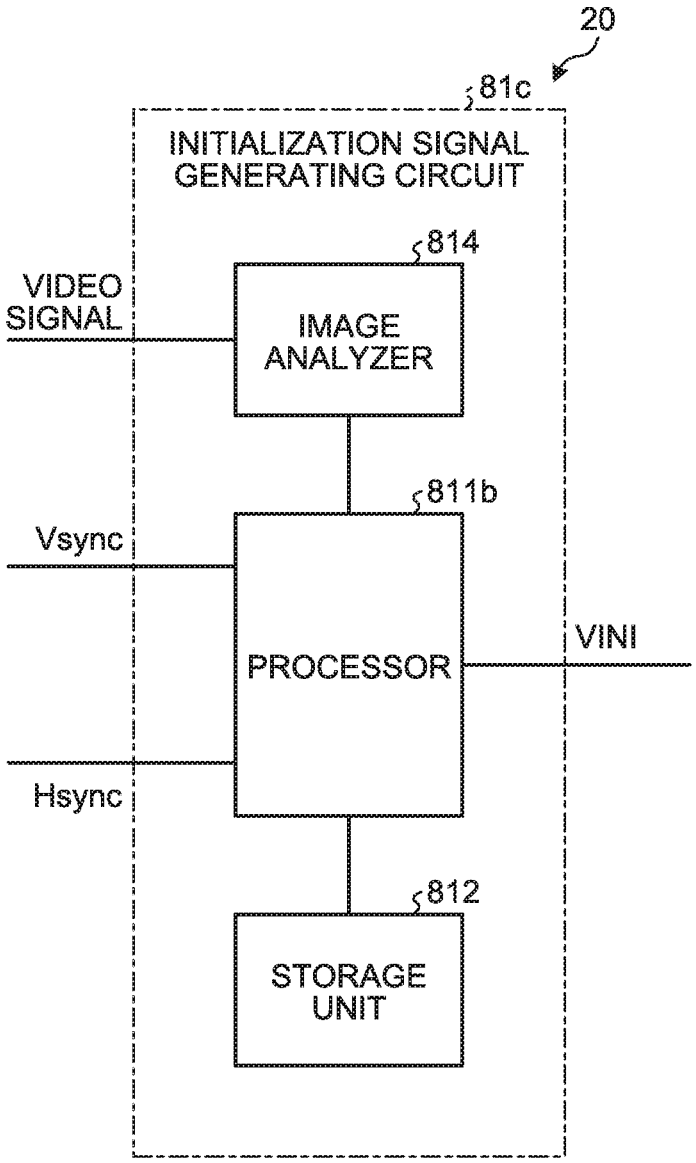
FIG. 22 is a diagram illustrating an example of a schematic block configuration of an initialization signal generating circuit in the display device according to a fifth embodiment.

FIG. 22 is a diagram illustrating an example of a schematic block configuration of the initialization signal generating circuit in the display device according to the fifth embodiment.

As illustrated in FIG. 22, in addition to a vertical synchronization signal Vsync and a horizontal synchronization signal Hsync of a video signal that are input from the controller 56, the video signal is input from the controller 56 to an initialization signal generating circuit 81*c* of the control circuit 20. The initialization signal generating circuit 81*c* includes a processor 811*b*, the storage unit 812, and an image analyzer 814.

The image analyzer 814 performs image analysis of the input video signal. Examples of an image analysis method to be employed by the image analyzer 814 includes histogram analysis. The present disclosure is not limited by an image analysis method to be employed by the image analyzer 814.

Figure 23:
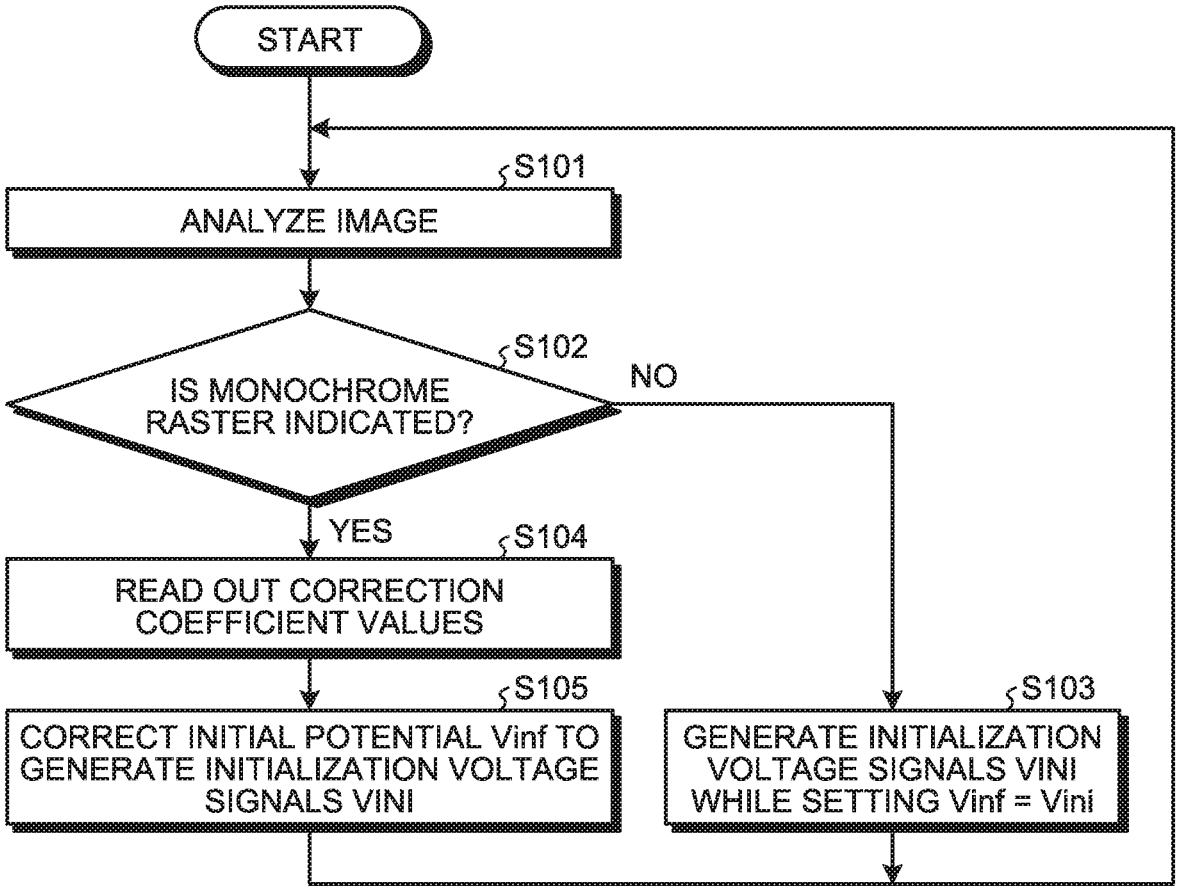
FIG. 23 is a flowchart illustrating an example of an initialization signal correction processing procedure according to the fifth embodiment.

FIG. 23 is a flowchart illustrating an example of an initialization signal correction processing procedure according to the fifth embodiment. Hereinafter, the operation of the initialization signal generating circuit 81*c* is described based on the flowchart illustrated in FIG. 23.

First, the image analyzer 814 analyzes a video signal input for one frame (1F) (Step S101).

Based on the image analysis result, the image analyzer 814 determines whether the video signal is a signal indicating that a monochrome raster is to be displayed (Step S102).

If the video signal is not a signal indicating that a monochrome raster is to be displayed (No at Step S102), the processor 811*b* generates data values of the potentials Vini (initialization potentials) of the initialization voltage signals VINI while the initial potential Vinf of the initialization voltage signals VINI is set as the potentials Vini (initial potentials) for all of the pixels 50 (Step S103).

If the video signal is a signal indicating that a monochrome raster is to be displayed (Yes at Step S102), the processor 811*b* reads out the correction coefficient values for the respective pixels 50 from the correction coefficient value information 8121 stored in the storage unit 812 (Step S104), and corrects the initial potential Vinf of the initialization voltage signal VINI with respect to each pixel 50 based on the vertical synchronization signal Vsync and the horizontal synchronization signal Hsync that are input from the controller 56, thereby generating data values of the potentials Vini (initialization potentials) of the initialization voltage signals VINI (Step S105).

If the video signal is not a signal indicating that a monochrome raster is to be displayed, that is, for example, if the video signal is a signal indicating that a natural image is to be displayed, luminance non-uniformity on the screen of the display area 38 is hardly observed visually. In the present embodiment, if the video signal is not a signal indicating that a monochrome raster is to be displayed, the processing is performed so as to generate data values of the potentials Vini (initialization potentials) of the initialization voltage signals VINI with the initial potential Vinf of the initialization voltage signals VINI set as the potentials Vini (initial potentials) for all of the pixels 50, that is, so as to supply the potentials Vini (initialization potentials) that are equal to each other to all of the pixels 50.

Sixth Embodiment

The following describes a display device according to a sixth embodiment with a focus on differences thereof with any of the first to the fifth embodiments while assigning the same reference signs to components thereof that have the same functions as those in any of the first to the fifth embodiments described above and omitting descriptions of the components.

In the present embodiment, an example is described in which the schematic configurations illustrated in FIG. 2 of the display area 38 and the control circuit 20 in the display device according to the first embodiment include an initialization signal generating circuit having a different configuration.

Figure 24:
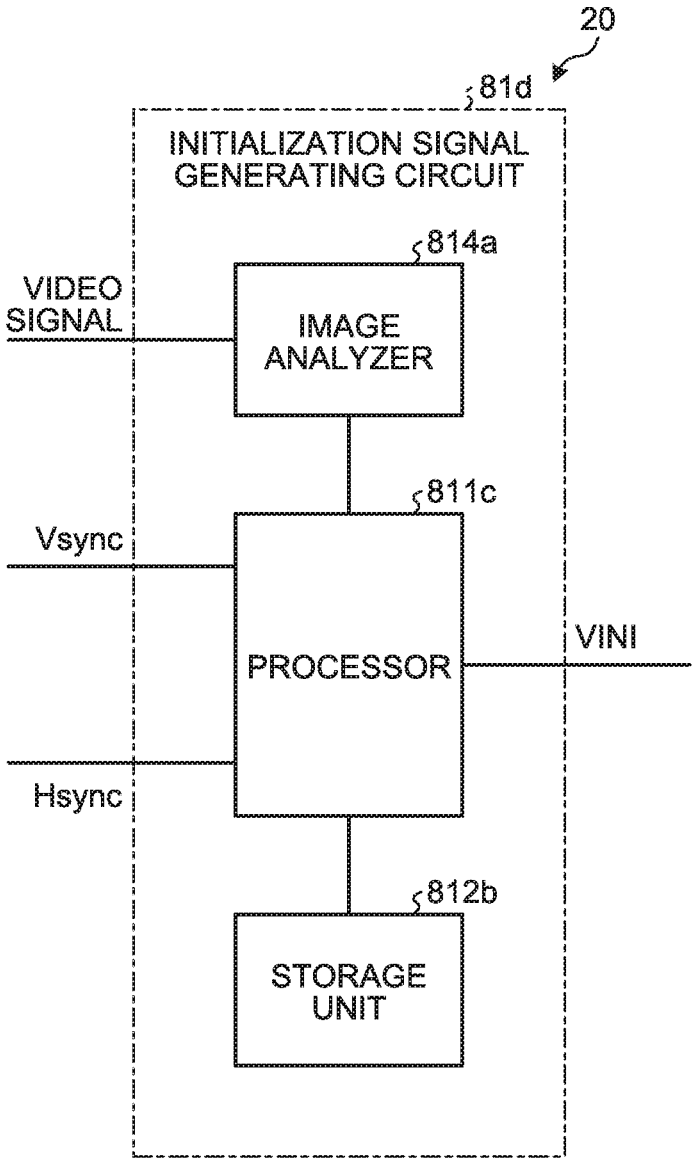
FIG. 24 is a diagram illustrating an example of a schematic block configuration of an initialization signal generating circuit of a display device according to a sixth embodiment.

FIG. 24 is a diagram illustrating an example of a schematic block configuration of the initialization signal generating circuit in the display device according to the sixth embodiment.

As illustrated in FIG. 24, a video signal, and a vertical synchronization signal Vsync and a horizontal synchronization signal Hsync of the video signal are input from the controller 56 to an initialization signal generating circuit 81*d* of the control circuit 20 as in the fifth embodiment. The initialization signal generating circuit 81*d* includes a processor 811*c*, a storage unit 812*b*, and an image analyzer 814*a*.

Figures 25, 26:
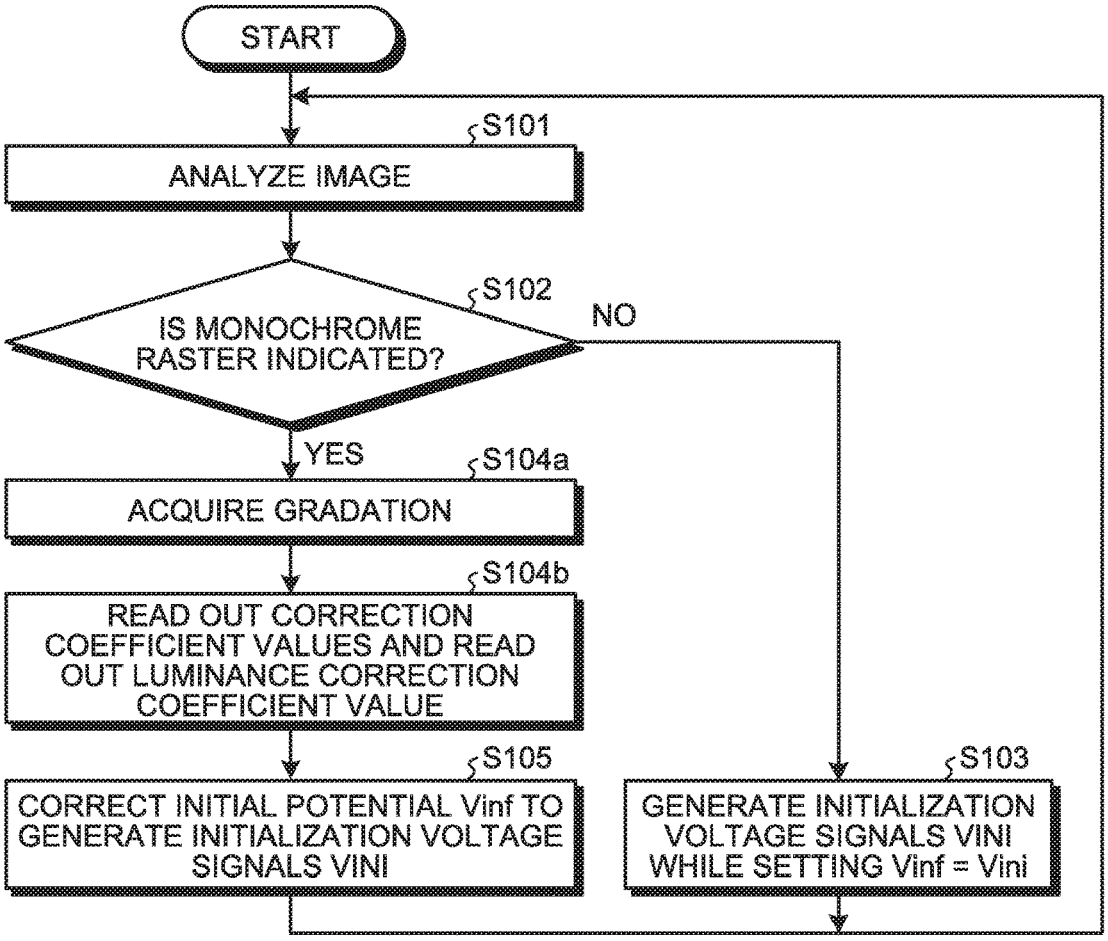
FIG. 25 is a diagram illustrating an example of luminance correction coefficient value information including luminance correction coefficient values for a plurality of luminance ranges.
FIG. 26 is a flowchart illustrating an example of an initialization signal correction processing procedure according to the sixth embodiment.

FIG. 25 is a diagram illustrating an example of luminance correction coefficient value information including luminance correction coefficient values for respective gradation ranges of a video signal.

In addition to the initial potential Vinf of the initialization voltage signals VINI and, for example, the correction coefficient value information 8121 illustrated in FIG. 10, the storage unit 812*b* has luminance correction coefficient values for respective gradation ranges of a video signal stored therein as luminance correction coefficient value information 8122 illustrated in FIG. 23.

As the example illustrated in FIG. 25, an example is illustrated in which, with the 256 gradations of a video signal divided into a plurality of gradation ranges the number of which is "r (r is an integer of at least 1)" for example, luminance correction coefficient values corresponding to the respective gradation ranges are previously set. A method for finding the luminance correction coefficient values stored as the luminance correction coefficient value information 8122 for the respective gradation ranges is not limited. The luminance correction coefficient values for the respective gradation ranges may be numeric data or may be discrete values such as digital data.

FIG. 26 is a flowchart illustrating an example of an initialization signal correction processing procedure according to the sixth embodiment. In the present embodiment, parts of processing that are different from the flowchart illustrated in FIG. 23 are described, and descriptions of the other parts thereof are omitted.

If the video signal is a signal indicating that a monochrome raster is to be displayed (Yes at Step S102), the image analyzer 814*a* acquires the gradation of the video signal (Step S104*a*).

The processor 811*c* not only reads out the correction coefficient values for the respective pixels 50 from the correction coefficient value information 8121 stored in the storage unit 812*b* but also reads out, from the luminance correction coefficient value information 8122 stored in the storage unit 812*b*, the luminance correction coefficient value according to the gradation acquired by the image analyzer 814*a* (Step S104*b*), and corrects the initial potential Vinf of the initialization voltage signal VINI with respect to each pixel 50 based on the vertical synchronization signal Vsync and the horizontal synchronization signal Hsync that are input from the controller 56, thereby generating data values of the potentials Vini (initialization potentials) of the initialization voltage signals VINI (Step S105).

The present disclosure is not limited by a method by which the processor 811*c* calculates the potentials Vini (initialization potentials) of the initialization voltage signals VINI for the respective pixels 50. For example, a configuration such that the potentials Vini (initialization potentials) of the initialization voltage signals VINI for the respective pixels 50 are calculated by multiplying the initial potential Vinf of the initialization voltage signals VINI by the correction coefficient values and the luminance correction coefficients for the respective pixels 50 may be employed. Alternatively, for example, a configuration such that the potentials Vini (initialization potentials) of the initialization voltage signals VINI for the respective pixels 50 are calculated by adding the correction coefficient values and the luminance correction coefficients for the respective pixels 50 to the initial potential Vinf of the initialization voltage signals VINI may be employed.

It is considered that the tone of luminance non-uniformity visually observed on the screen of the display area 38 varies depending on the gradations of a video signal. In the present embodiment, if the video signal is a signal indicating that a monochrome raster is to be displayed, the potentials Vini (initialization potentials) are generated for the respective pixels 50 in accordance with the gradations of the monochrome raster, so that luminance non-uniformity can be suppressed in the X direction (first direction) and the Y direction (second direction) on the screen of the display area 38 irrespective of the gradations of the monochrome raster.

In each of the above-described embodiments, suppression of luminance non-uniformity attributable to locations from which power is fed to the drive potential $V_{DD}$ and the reference potential $V_{SS}$ is described. However, luminance non-uniformity attributable to, for example, a factor that may occur in the manufacture process for the display area 38 or 38*a*, such as variations in the threshold voltages (forward voltage drop VF) of the organic light-emitting diodes 90 or variations of the light conversion efficiency thereof, can also be suppressed in a manner such that, as described above, at a time such as when shipping inspection is performed on the display device 30, with a monochrome raster displayed, values that make the luminance of an image displayed on the display area 38 or 38*a* substantially uniform in the Y direction (second direction) or both in the X direction (first direction) and the Y direction (second direction) are obtained as the correction coefficient values to be stored as the correction coefficient value information 8121, 8121*a*, or 8121*b*.

In each of the above-described embodiments, a configuration such that each pixel row is provided with one of the reset lines 78 and one of the reset switches 64 is described. That is, a plurality of pixels included in that pixel row shares that one of the reset lines 78 and that one of the reset switches 64. Alternatively, a configuration such that, with each of the pixel rows separated into a plurality of sections, each section shares one of the reset lines 78 and one of the reset switches 64 may be employed.

Otherwise, a configuration such that each two or more of the pixel rows share one of the reset switches 64 may be employed. In this configuration, each of the pixel rows is provided with one of the reset lines 78, and one of the reset switches 64 that is common to each two or more of the reset lines 78 switches between coupling and decoupling thereof to and from the reset power supply PVRS.

Another layout in which a relatively small number of pixel rows, such as two adjacent pixel row, shares one of the reset lines 78 may be employed, for example. Specifically, each of the reset lines 78 is formed of a trunk part extending in the row direction and branch parts extending in the column direction in positions corresponding to the respective columns.

While a configuration such that the drive transistor 92 is formed of an n-type TFT is described in each of the above-described embodiments, an alternative configuration such that the drive transistor 92 is formed of a p-type TFT may be employed. Likewise, a configuration such that any of the lighting switch 94, the reset switch 64, the writing switch 96, and the initialization switch 112 is formed of a p-type TFT instead of being formed of an n-type TFT as described in each of the above-described embodiments may be employed. That is, the circuit configurations illustrated in FIG. 3 and FIG. 12 described in the above-described embodiments are examples and may each be formed of any one of various circuits such as a circuit that includes p-type TFTs only and a circuit that includes at least one p-type TFT and at least one n-type TFT together.

Each of the above-described embodiments can provide a display device capable of preventing luminance non-uniformity.

Components from the above-described embodiments can be used in combination as appropriate. It should be naturally understood that the present invention produces other operation and effect that are produced by the aspects described in each of the present embodiments and that are obvious from the disclosure of the present description or can be conceived by the skilled person as appropriate.

What is claimed is:

1. A display device comprising:

a display area including a plurality of pixels arrayed next to one another in a first direction and in a second direction that is different from the first direction, wherein each of the pixels includes a light-emitting element configured to emit light by a current flowing therethrough, a drive transistor, and a holding capacitance, while one terminal of the light-emitting element is coupled to one of a source and a drain of the drive transistor, a first potential is supplied to the other terminal of the light-emitting element, a second potential that is higher than the first potential is supplied to the other one of the source and the drain of the drive transistor, the holding capacitance is coupled between the source and a gate of the drive transistor, and the display device being configured to (i) write initialization potentials into the gates of the respective drive transistors in accordance with a distance in a first direction from a power supply portion, wherein power is supplied from both sides of the display area in the first direction, where the array direction of the signal line is in the first direction, such that an initialization potential applied a pixel in a center, in the first direction, of the display area is less than initialization potentials applied to respective pixels at both ends, in the first direction, of the display area, then (ii) write video writing potentials into the gates of the respective drive transistors.

2. The display device according to claim 1, wherein the display device sets the initialization potentials to be supplied to the respective pixels to values that allow an image to have substantially uniform luminance in the second direction, the image being to be displayed on the display area by the video writing potentials when the video writing potentials to be written into the respective pixels are the same.

3. The display device according to claim 2, wherein the display device sets the initialization potentials to be supplied to the respective pixels to values that allow an image to have substantially uniform luminance in the first direction, the image being to be displayed on the display area by the video writing potentials when the video writing potentials to be written into the respective pixels are the same.

4. The display device according to claim 2, wherein the display device sets the initialization potential individually for each of the pixels.

5. The display device according to claim 2, wherein the display device sets the same initialization potential for the pixels that are arrayed next to one another in the first direction.

6. The display device according to claim 2, wherein the display device sets the same initialization potential for the pixels that are included in each of the pixel groups corresponding to a plurality of regions obtained by dividing the display area.

7. The display device according to claim 1, further comprising:

an image analyzer configured to analyze a video signal, wherein the display device sets the same initialization potential for all of the pixels provided in the display area when the video signal analyzed by the image analyzer does not represent a monochrome raster.

8. The display device according to claim 7, wherein, when the video signal analyzed by the image analyzer represents a monochrome raster, the display device sets, in accordance with gradations of the monochrome raster, the initialization potentials to be supplied to the respective pixels.

9. The display device according to claim 1, wherein each of the pixels includes a first signal line to which the corresponding video writing potential and the corresponding initialization potential are applied during different periods.

10. The display device according to claim 1, wherein each of the pixels includes:

a first signal line to which the corresponding video writing potential is applied; and a second signal line to which the corresponding initialization potential is applied.

* * * * *